US007429854B2

(12) United States Patent
Kimura

(10) Patent No.: US 7,429,854 B2
(45) Date of Patent: Sep. 30, 2008

(54) CMOS CURRENT MIRROR CIRCUIT AND REFERENCE CURRENT/VOLTAGE CIRCUIT

(75) Inventor: Katsuji Kimura, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 0 days.

(21) Appl. No.: 11/262,940

(22) Filed: Nov. 1, 2005

(65) Prior Publication Data

US 2006/0091940 A1 May 4, 2006

(30) Foreign Application Priority Data

Feb. 11, 2004 (JP) ..... 2004-319426

(51) Int. Cl.
*G05F 3/16* (2006.01)

(52) U.S. Cl. ..... 323/315

(58) Field of Classification Search ..... 323/311, 323/312, 313, 314, 315, 316
See application file for complete search history.

(56) References Cited

U.S. PATENT DOCUMENTS

| | | | | |
|---|---|---|---|---|
| 4,897,596 | A * | 1/1990 | Hughes et al. | 323/315 |
| 5,357,149 | A | 10/1994 | Kimura | |
| 5,751,639 | A * | 5/1998 | Ohsawa | 365/226 |
| 5,889,431 | A * | 3/1999 | Csanky | 327/543 |
| 5,949,278 | A | 9/1999 | Oguey | |
| 5,990,727 | A | 11/1999 | Kimura | |
| 6,831,505 | B2 * | 12/2004 | Ozoe | 327/541 |
| 6,919,753 | B2 * | 7/2005 | Wang et al. | 327/513 |

FOREIGN PATENT DOCUMENTS

| | | |
|---|---|---|
| JP | 46-16468 | 5/1971 |
| JP | 2800523 | 7/1998 |
| JP | 3039611 | 3/2000 |

OTHER PUBLICATIONS

R. J. Widlar, "Some Circuit Design Techniques for Linear Integrated Circuits", IEEE Transaction on Circuit Theory, vol. CT-12, No. 4, pp. 586-590, Dec. 1965.

H. J. Oguey and D. Aebischer, "CMOS Current Reference Without Resistance", IEEE Journal of Solid-State Circuits, vol. 32, No. 7, pp. 1132-1135, Jul. 1997.

* cited by examiner

*Primary Examiner*—Adolf Berhane
(74) *Attorney, Agent, or Firm*—McGinn IP Law Group PLLC

(57) ABSTRACT

Disclosed is a CMOS current mirror circuit including a first MOS transistor and a second MOS transistor constituting a current mirror, in which a drain of the first MOS transistor and a gate of the second MOS transistor are connected in common, a source of the first MOS transistor is directly grounded, and a gate of the first MOS transistor is connected to the drain of the first MOS transistor through a third MOS transistor which has a source connected to the drain of the first MOS transistor, a drain connected to the gate of the first MOS transistor, and a gate being biased. The source of the second MOS transistor is directly grounded. Current is input to the drain of the third MOS transistor. The drain current of the second MOS transistor is mirrored by cascode current mirror circuits. An output current is output from the source of a MOS transistor for conversion to a voltage by a circuit that receives the current which outputs a reference voltage.

18 Claims, 23 Drawing Sheets

CMOS CURRENT MIRROR CIRCUIT AND REFERENCE CURRENT/VOLTAGE CIRCUIT

FIELD OF THE INVENTION

The present invention relates to a CMOS current mirror circuit and a CMOS reference current/voltage circuit. More specifically, the present invention relates to the CMOS current mirror circuit having no resistance element and the CMOS reference current/voltage circuit having a small temperature characteristic, both formed in a semiconductor integrated circuit.

BACKGROUND OF THE INVENTION

A nonlinear CMOS current mirror circuit that uses a resistor is described in detail in Patent Document 1 (JP Patent Kokoku Publication No. JP-B-S46-16468), Patent Document 2 (JP Patent No. 2800523), Patent Document 3 (JP Patent No. 3039611), and the like, for example. As the well known CMOS current mirror circuit, a reverse Widlar current mirror circuit shown in FIG. 20 is described in the Patent Document 3 (JP Patent No. 3039611) and the like.

As for a Widlar current mirror circuit shown in FIG. 21, a circuit that uses bipolar transistors is described in Non-patent Document 1 (R. J. Widlar. 'Some Circuit design techniques for Linear Integrated Circuits,' IEEE Transaction on Circuit Theory, VOL. CT-12, No. 4, pp. 586-590, December 1965.), and has the name of the author of the thesis.

In the circuit shown in FIG. 21, the bipolar transistors are just replaced by MOS transistors in the circuit that was proposed nearly 40 years ago, and identification of the first patent document about this circuit has not become possible yet.

Likewise, a Nagata current mirror circuit shown in FIG. 22 is also the circuit that was proposed nearly 40 years ago (for which patent application was filed in 1966), and is now referred to as the one having the name of the inventor of the circuit, by the inventor of the present invention.

The reverse Widlar current mirror circuit shown in FIG. 20 is described in detail in the document on the patent made by the inventor of the present invention (JP Patent No. 3039611), and the like. Due to the square characteristic of the MOS transistor, an output current has a negative temperature characteristic (which is scarcely known). When the temperature becomes low, the output current increases. When the temperature becomes high, the output current decreases.

On the other hand, the Widlar current mirror circuit shown in FIG. 21 has a monotonous characteristic. When an input current is increased, an increase in an output current is gradually reduced. More specifically, it can be seen that the circuit was originally proposed to obtain a small current. Further, it is well known that the Widlar current mirror circuit has a positive temperature characteristic.

The Nagata current mirror circuit shown in FIG. 22 has a peaking characteristic rather than the monotonous characteristic described before. More specifically, an output current increases monotonously with an input current, and when the input current further increases, an increase in the output current is gradually reduced to reach the peak value of the maximum output current. Then, when the input current is further increased, the output current is gradually reduced, to the contrary. A lot of applications can be conceived for the Nagata current mirror circuit because the Nagata current mirror circuit has this peaking characteristic. However, actually, the Nagata current mirror circuit is used for an alternative to a characteristic that can be implemented by the Widlar current mirror circuit in most cases. The Nagata current mirror circuit has not been so often used for the application that uses the peaking characteristic.

The potentiality of the Nagata current mirror circuit, however, is high, so that the Nagata current mirror circuit can be used for more applications.

Namely, various applications as follows have been hitherto clarified:

(1) an alternative to the Widlar current mirror circuit used in the region of a monotonous increase characteristic
(2) regulation of current used in the vicinity of the peaking characteristic
(3) implementation of a negative feedback loop circuit used in the region of a monotonous decrease characteristic
(4) start-up circuitry The respective input-output characteristics of the reverse Widlar current mirror circuit, Widlar current mirror circuit, and Nagata current mirror circuit as described above become similar to the characteristic of the present invention shown in FIG. 7, which will be described later.

Any of the reverse Widlar current mirror circuit, Widlar current mirror circuit, and Nagata current mirror circuit, however, has a noticeable positive or negative temperature characteristic. On the hand, in many of the applications, there is seen a case where the circuit with no temperature characteristic or a smaller temperature characteristic is better.

Further, the temperature characteristic of a resistor RI, the magnitude of a manufacturing variation of resistors (of approximately ±20% in general) that would cause a more severe influence, and a CMOS transistor manufacturing variation of resistors independent of the manufacturing variation are present. Even if the manufacturing variation of resistors is ±20%, nearly ±30% of a variation in the output current of the current mirror circuit must be allowed for. This would make it impossible to obtain a satisfactory accuracy, so that external installation of the resistor or trimming of a resistance element would be required.

Conventionally, there is not known a CMOS current mirror circuit that employs no resistor of the type described above. In term of the circuit as well, the configuration can be a simple circuit with a small circuit size as shown in FIGS. 20 to 22. Thus, the CMOS current mirror circuit that causes an MOS transistor to operate in a linear region, thereby equivalently using it as a resistor has been considered to have no advantages. However, as will be described below as embodiments of the present invention, in this CMOS current mirror circuit, it has become clear that the influence of the manufacturing variation on the circuit characteristics of the circuit can be reduced due to use of MOS transistors having the same manufacturing variation alone, and that the temperature characteristic of the circuit can be reduced due to the same temperature characteristic of the MOS transistors. Thus, this circuit has great advantages.

Further, as the CMOS reference current/voltage circuit, there is known a circuit that employs no resistor by operating the MOS transistor in the linear region and equivalently using it as the resistor. This is, however, a special example in which two MOS transistors M1 and M2 constituting a current mirror circuit are operated in weak inversion (sub-threshold region). As the CMOS reference current circuit having the positive temperature characteristic, for example, a circuit shown in FIG. 23 is disclosed in Patent Document 4 (U.S. Pat. No. 5,949,278) and Non-patent Document 2 (IEEE Journal of Solid-State Circuits, Vol. 32, No. 7, pp. 1132-1135, July 1997.) and the like.

In most cases, the MOS transistor is generally operated in a saturation region. As in an example shown in FIG. 23, the circuit is configured by causing the two MOS transistors M1 and M2 constituting the current mirror circuit to operate in weak inversion, in expectation of a characteristic just like that of the bipolar transistor. When the MOS transistor is operated in weak inversion, the current flown becomes a nA (nanoampere) order, which is reduced from the current that can be flown through the ordinary MOS transistor operated in the saturation region by a factor of several orders of magnitude. Thus, an extreme limitation is imposed on the applications of the circuit. Accordingly, the example shown in FIG. 23 is not versatile, but a special example.

Further, when the two MOS transistors constituting the nonlinear current mirror circuit as described above are self-biased, the influence of a linear current mirror circuit used for self-biasing will appear more noticeably than the characteristic of the self-biased nonlinear current mirror circuit.

When the nonlinear current mirror circuit is self-biased, for example, the nonlinear current mirror circuit will have the positive temperature characteristic, irrespective of whether the original temperature characteristic of the nonlinear current mirror circuit is positive or negative.

Accordingly, the characteristic of the original nonlinear current circuit will sometimes become different from that of the self-biased nonlinear current mirror circuit of the same circuit, so that it often happens that these circuits cannot be treated to be the same.

Referring to FIG. 23, MOS transistors M4 and M3 constitute a current mirror circuit, while the MOS transistor M4 and an MOS transistor M5 constitute a current mirror circuit. Further, the circuit is configured so that between the source of the MOS transistor M1 and the ground, a circuit element (generally a resistance element) for restricting a flow of current, or an MOS transistor M7 in this example is operated in the linear region to be equivalently regarded as the resistance element. As described above, it is arranged that the MOS transistors M2 and M1 constitute the nonlinear current mirror circuit. That is, the reference current circuit of this type, as the simplest circuit form, is implemented by self-biasing the nonlinear current mirror circuit. By the way, though the reference current circuit of a self-biasing type always requires start-up circuitry, the start-up circuitry is omitted in this drawing.

When the MOS transistors M1 and M2 operate in weak inversion, a source voltage VS1 of the MOS transistor M1 is expressed as follows:

$$V_m = V_r\, 1n(K_1 K_2) \tag{1}$$

where $K_1$ indicates the transconductance parameter ratio of the MOS transistor M1 with respect to the MOS transistor M2, while $k_2$ indicates the transconductance parameter ratio of the MOS transistor M3 with respect to the MOS transistor M4. A transconductance parameter β is expressed as β=μ(COX/2)(W/L), where μ indicates effective mobility of a carrier (of an n channel) or a hole (of a p channel). COX is the capacitance of a gate oxide film per unit area. W and L indicate a gate width and a gate length, respectively. VT which indicates a thermal voltage, is expressed as VT=kT/q (k: a Boltzmann constant, T: absolute temperature, q: the unit electronic charge).

As for the characteristic of the MOS transistor, when a drain current thereof is indicated by $I_D$, a gate-to-source voltage thereof is indicated by $V_{GS}$, a drain-to-source voltage thereof is indicated by $V_{DS}$, and a threshold voltage thereof is indicated by $V_{TH}$, the following equation holds in the saturation region:

$$I_D = \beta(V_{GS}, V_{TH})^2 \tag{2}$$

In the linear region, the following equation holds:

$$I_D = 2n\beta\{(V_{GS} - V_{TH})V_{DS} - nV_{DS}^2/2\} \tag{3}$$

In weak inversion, the following equations hold:

$$I_D = I_S \exp\{(V_{GB} - V_{THo})/(nV_T)\}\exp(-V_{SB}/V_T) \tag{4}$$

$$I_S = 2n\,\beta V_T^2 \tag{5}$$

where B indicates a back gate, $V_{GB}$ indicates a gate voltage with respect to the bulk, $V_{SB}$ indicates a source-voltage with respect to the bulk, and n indicates a correcting coefficient when a low drain-to-source voltage is applied.

Equation (2) is applied to the MOS transistor M6, while Equation (3) is applied to the MOS transistor M7. Then, the drain currents $I_{D6}$ and $I_{D7}$ of MOS transistors M6 and M7 are given by:

$$I_{D6} = K_3\beta(V_{GS6} - V_{TH})^2 \tag{6}$$

$$I_{D7} = 2nK_4\beta\{(V_{GS6} - V_{TH})V_{S1} - nV_{S1}^2/2\} \tag{7}$$

where the transconductance parameter ratio of the MOS transistor M6 with respect to the MOS transistor M2 is indicated by $K_3$, while the transconductance parameter ratio of the MOS transistor M7 with respect to the MOS transistor M2 is indicated by $K_4$.

The MOS transistors M4 and MS constitute the current mirror circuit with a current ratio of one to $K_5$. Thus, the following equation holds:

$$I_{D6} = K_5 \times I_{D7} \tag{8}$$

When $(V_{GS6} - V_{TH})$ obtained from Equation (6) is substituted into Equation (7) for solution of this, the following equation is obtained:

$$I_{D1} = 2n^2 K_4 \beta V_{S1}^2 \left( \frac{K_4 K_5}{K_3} - \frac{1}{2} \pm \frac{K_4}{K_3}\sqrt{K_5}\sqrt{K_5 - \frac{K_3}{K_4}} \right) \tag{9}$$

When Equation (1) is substituted into Equation (9), the following equation is derived:

$$I_{D1} = 2n^2 K_4 \beta V_T^2 \{\ln(K_1 K_2)\}^2 \left( \frac{K_4 K_5}{K_3} - \frac{1}{2} \pm \frac{K_4}{K_3}\sqrt{K_5}\sqrt{K_5 - \frac{K_3}{K_4}} \right) \tag{10}$$

The temperature characteristic of the transconductance parameter β is expressed as follows due to:

$$\mu = \mu_0\left(\frac{T_0}{T}\right)^m \qquad \beta = \beta_0\left(\frac{T_0}{T}\right)^m \tag{11}$$

where m in $(T0/T)^m$ assumes a value between 1.5 and 2 (1.5<m<2).

Accordingly, the following equation is obtained:

$$I_{D1} = 2n^2 K_4 \beta_0 \left(\frac{T}{T_0}\right)^{2-m} \frac{k^2}{q^2}\{\ln(K_1 K_2)\}^2 \left( \frac{K_4 K_5}{K_3} - \frac{1}{2} \pm \frac{K_4}{K_3}\sqrt{K_5}\sqrt{K_5 + \frac{K_3}{K_4}} \right) \tag{12}$$

In the above-mentioned Equations (9), (10), and (12), a symbol ± is used so that the solutions of the equations can be traced. Referring to FIG. 23, it can be seen that as the $K_4$ is increased, a current $I_{D1}$ is increased. It is therefore appropriate to replace the symbol ± by +.

Accordingly, the current $I_{D1}$ has the positive temperature characteristic. That is, it serves as a PTAT (proportional to absolute temperature) current source.

[Patent Document 1]

JP Patent Kokoku Publication No. JP-B-S46-16468

[Patent Document 2]

JP Patent No. 2800523

[Patent Document 3]

JP Patent No. 3039611

[Patent Document 4]

U.S. Pat. No. 5949278

[Non-patent Document 1]

R. J. Widlar. "Some Circuit design techniques for Linear Integrated Circuits," IEEE Transaction on Circuit Theory, VOL. CT-12, No. 4, pp. 586-590, December 1965.

[Non-patent Document 2]

H. J. Oguey and D. Aebischer, "CMOS Current Reference Without Resistance," IEEE Journal of Solid-State Circuits, Vol. 32, No. 7, pp. 1132-1135, July 1997.

SUMMARY OF THE DISCLOSURE

The two MOS transistors M6 and M7 in FIG. 23 constitute a current mirror circuit in which the MOS transistor M6 always operates in the saturation region, while the MOS transistor M7 always needs to operate in the linear region.

It seems difficult to make the two MOS transistors M6 and M7 constituting the current mirror circuit operate in the saturation region and the linear region that are different, respectively.

In a conventional approach, the reference current circuit has the positive temperature characteristic and it is difficult to implement the current mirror circuit, reference current circuit, and reference voltage circuit all having a small temperature characteristic.

The present invention has been made in view of this.

A current mirror circuit, according the present invention, comprising a first transistor and a second transistor, and an active device disposed on an input side or an output side of the current mirror circuit to accommodate a predetermined nonlinear input/output characteristic of the current mirror circuit. A CMOS current mirror circuit and a CMOS reference current/voltage circuit according to the present invention are generally configured as follows.

In accordance with a first aspect of the present invention, a first and second transistors with gates thereof connected in common constitute the current mirror circuit. The source of the first MOS transistor is grounded through a third MOS transistor. The source of the second MOS transistor is directly grounded. The source of the third MOS transistor is directly grounded, the drain of the third MOS transistor is connected to the source of the first MOS transistor, and the gate of the third MOS transistor is connected to a power supply. The gate of the first MOS transistor and the drain of the first MOS transistor are connected in common for current input, and an output current is output from the drain of the second MOS transistor.

In accordance with a second aspect of the present invention, first and second transistors with gates thereof connected in common constitute the current mirror circuit. The source of the first MOS transistor is directly grounded. The source of the second MOS transistor is grounded through a third MOS transistor. The source of the third MOS transistor is directly grounded, the drain of the third MOS transistor is connected to the source of the second MOS transistor, and the gate of the third MOS transistor is connected to a power supply. The gate of the first MOS transistor and the drain of the first MOS transistor are connected in common for current input. An output current is supplied from the drain of the second MOS transistor.

In accordance with a third aspect of the present invention, first and second transistors with gates thereof connected in common constitute the current mirror circuit. The source of the first MOS transistor is directly grounded. The gate of the first MOS transistor and the drain of the first MOS transistor are connected through a third MOS transistor. The source of the third MOS transistor is connected to the drain of the first MOS transistor, the drain of the third MOS transistor is connected to the gate of the first MOS transistor, and the gate of the third MOS transistor is connected to a bias voltage source. The source of the second MOS transistor is directly grounded. The gate of the first MOS transistor and the drain of the first MOS transistor are connected in common, for current input. An output current is supplied from the drain of the second MOS transistor.

Preferably, in accordance with the first aspect of the present invention, the gate of a fourth MOS transistor and the drain of the fourth MOS transistor are connected in common for current input. The fourth MOS transistor is cascode-connected to the third MOS transistor. A bias voltage is supplied to the gate of the third MOS transistor.

Preferably, in accordance with the second aspect of the present invention, the gate of a fourth MOS transistor and the drain of the fourth MOS transistor are connected in common for current input. The fourth MOS transistor is cascode-connected to the third MOS transistor. A bias voltage is supplied to the gate of the third MOS transistor.

Preferably, in accordance with the third aspect of the present invention, the gate of a fourth MOS transistor and the drain of the fourth MOS transistor are connected in common for current input. The fourth MOS transistor is cascode-connected to the third MOS transistor. A bias voltage is supplied to the gate of the third MOS transistor.

Preferably, in accordance with the first aspect of the present invention, the (W/L) ratio of the gate width to the gate length of the first MOS transistor is larger than the (W/L) ratio of the gate width to the gate length of the second MOS transistor.

Preferably, in accordance with the second aspect of the present invention, the (W/L) ratio of the gate width to the gate length of the first MOS transistor is smaller than the (W/L) ratio of the gate width to the gate length of the second MOS transistor.

Alternatively, at least the first MOS transistor and the second MOS transistor constituting the current mirror circuit may be self-biased, for current output.

Alternatively, the output current may be converted to the voltage so that a reference voltage circuit may be configured.

In accordance with a fourth another aspect of the present invention, both of a first MOS transistor and a second MOS transistor constituting a current mirror circuit operate in a weak inversion region. The first MOS transistor and the second MOS transistor constitute the current mirror circuit which is nonlinear and in which a current flow from the first MOS transistor to a power supply (ground) is performed through a third MOS transistor operating in a linear region, and a current flow from the second transistor to the power supply (ground) is directly performed. The source of the third MOS transistor is connected to the power supply (ground), the drain of the third MOS transistor is connected in common to the source of a diode-connected fourth MOS transistor and to the source of the first MOS transistor, and the gate of the third MOS transistor is connected to the gate of the fourth MOS transistor. The first MOS transistor, the second MOS transistor, and the fourth MOS transistor are individually driven by three currents that are proportional to one another.

Preferably, in accordance with the fourth aspect of the present invention, a current flow from the second MOS transistor to the power supply (ground) and a current flow from the third MOS transistor to the power supply (ground) may be performed through a fifth MOS transistor, wherein the fifth MOS transistor operates in the linear region.

Preferably, in accordance with the fourth aspect of the present invention, a reference voltage is output from the common gate of the first and second MOS transistors.

According to the present invention, by cascode-connecting the MOS transistors, a MOS transistor operating in the linear region can be obtained. Further, comparatively stable drain voltages can be obtained and the temperature characteristics of the MOS transistors can be accordingly matched, as a result of which, respective temperature characteristics of the MOS transistors can be cancelled out to one another, thereby implementing a circuit with a small temperature characteristic.

The meritorious effects of the present invention are summarized as follows.

According to the present invention, the circuit is implemented only by the MOS transistors having the same temperature characteristics and the temperature characteristics are mutually cancelled out, thereby reducing the temperature characteristic (dependency).

According to the present invention, two MOS transistors with gate voltages thereof made common are cascode-connected, for operation in the linear region. The MOS transistor thus can be operated in the linear region with reliability, and the nonlinear current mirror circuit can be configured by using the MOS transistor in place of a resistance element.

According to the present invention, the MOS transistor is used in place of the resistance element, and no resistance element is employed. A variation thus can be reduced.

Still other effects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

A best mode for carrying out the present invention will be described. A current mirror circuit according to the present invention includes first and second transistors constituting a current mirror, and includes an active element on the input or output side of the current mirror circuit to accommodate a predetermined nonlinear input-output characteristic of the current mirror circuit. The first transistor and the second transistor are an input side and output side transistors, respectively. Preferably, as the active element, a third transistor with a control terminal thereof being biased to a predetermined potential is connected either of between a ground (power supply) and one terminal of the first transistor (in FIG. 1), between the ground (power supply) and one terminal of the second transistor on the output side (in FIG. 2), or between the first transistor and the supply terminal of an input current (in FIG. 3).

In a reference current circuit according to the present invention, one terminal of first and second transistors (M1, M2) on the output and input sides of the current mirror circuit are directly connected to the ground (power supply), respectively. Both of the first and second transistors operate in a weak inversion region. The circuit includes a third transistor (M7) connected between one terminal of the first transistor and the ground (power supply), for operating in a linear region. The circuit further includes a fourth transistor (M6) connected to a connecting point between the first transistor (M1) and the third transistor (M7), which is diode-connected. The control terminal of the third transistor is connected to the control terminal of the fourth transistor. The first, second, and fourth transistors are individually driven by respective three currents that are proportional to one another. The driving capability ratio of the third transistor (M7) to the second transistor (M2) and the driving capability ratio of the fourth transistor (M6) to the second transistor (M2) can be set independently. A description will be given below in connection with embodiments.

Figure 1:
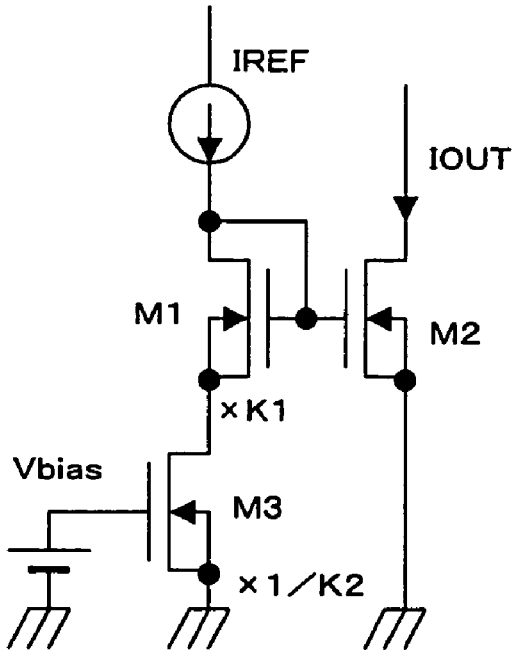
FIG. 1 is a diagram showing a configuration of an embodiment of the present invention.

FIG. 1 is a diagram showing a circuit configuration of a CMOS current mirror circuit according to an embodiment of the present invention. Referring to FIG. 1, in the present embodiment, a first MOS transistor M1 and a second MOS transistor M2 (which are n-channel MOS transistors) with gates thereof connected in common constitute a current mirror circuit. The source of the first MOS transistor M1 is grounded through a third MOS transistor M3, and the source of the second MOS transistor M2 is directly grounded. The source of the third MOS transistor M3 is directly grounded. The drain of the third MOS transistor M3 is connected to the source of the first MOS transistor M1, and the gate of the third MOS transistor M3 is connected to a bias voltage supply $V_{bias}$. The gate and drain of the first MOS transistor M1 are connected in common for current input, and the current is output from the drain of the second MOS transistor M2. The MOS transistors M1 and M2 operate in the saturation region, while the MOS transistor M3 operates in the linear region.

Figure 23:
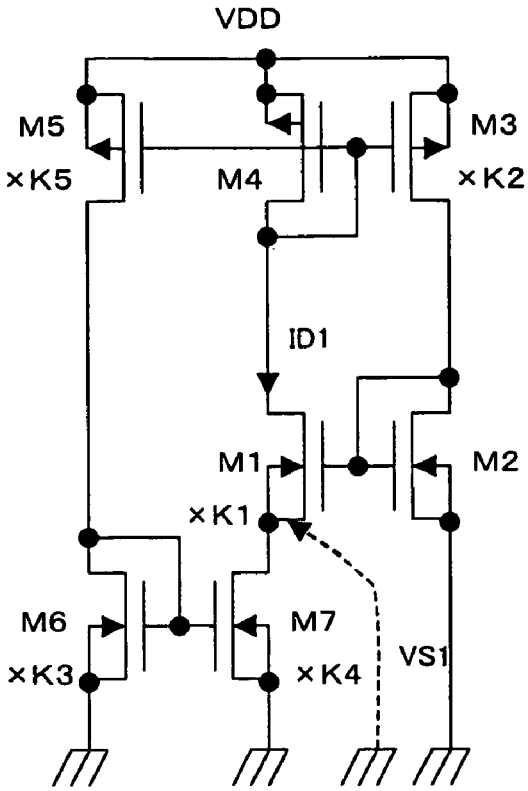
FIG . 23 PRIOR ART
FIG. 23 is a diagram showing a configuration of a conventional reference current circuit.

The current mirror circuit is different from a conventional circuit in FIG. 23 in that the circuit is a nonlinear current mirror circuit that is not self-biased. Further, this circuit is not a special example in which an operation is performed due to weak inversion in a sub-threshold region. As in most of MOS transistor applications, assuming a case in which the current mirror circuit operates in the saturation region, the MOS transistors M1 and M3 share a current $I_{REF}$, and the drain currents $I_{D1}$, $I_{D2}$ and $I_{D3}$ of the respective transistors M1, M2 and M3 are respectively expressed as follows:

$$I_{REF}=I_{D1}=K_1\beta(V_{GS2}-V_{S1}-V_{TH})^2 \tag{13}$$

$$I_{OUT}=I_{D2}=\beta(V_{GS2}-V_{TH})^2 \tag{14}$$

$$I_{REF}=I_{D3}=2n(1/K_2)\beta\{(V_{bias}-V_{TH})V_{S1}-nV_{S1}^2/2\} \tag{15}$$

From Equation (13), the following equation is derived:

$$V_{GS2}-V_{TH}=V_{S1}+\sqrt{\frac{I_{REF}}{K_1\beta}} \tag{16}$$

From Equation (15), $V_{S1}$ is worked out as follows:

$$V_{S1}=\frac{1}{n}\left\{(V_{bias}-V_{TH})\pm\sqrt{(V_{bias}-V_{TH})^2-\frac{K_2}{\beta}I_{REF}}\right\} \tag{17}$$

The relationship between $I_{REF}$ and $I_{OUT}$, cannot be analytically expressed. However, when the value of $V_{S1}$ is small, the term of the square of the $V_{S1}$ in Equation (15) can be neglected. Then, as is often said, the MOS transistor M3 that operates in the linear region may be regarded substantially as a resistor. Alternatively, practically, the MOS transistor M3 may be considered to be a resistor that has a second-order dependence on voltage.

Figure 20:
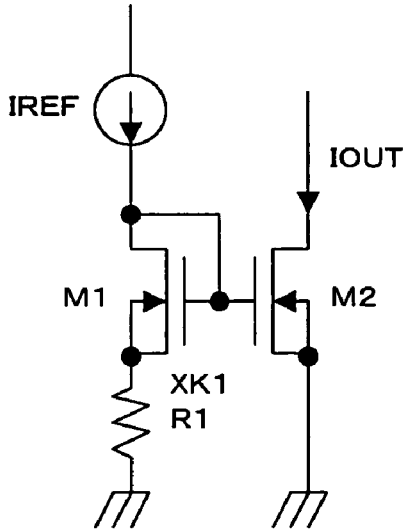
FIG . 20 PRIOR ART
FIG. 20 is a diagram showing a configuration of a conventional reverse Widlar current mirror circuit.

In this case, the characteristic corresponding to the characteristic of a conventional reverse Wildar current mirror circuit shown in FIG. 20 is expected. Actually, MOS transistors have a temperature characteristic. Though the MOS transistor M3 is identical to the MOS transistors M1 and M2 that constitute a nonlinear reverse Widlar current mirror circuit, a difference therebetween is that the operation is performed in the linear region or the saturation region.

Figure 2:
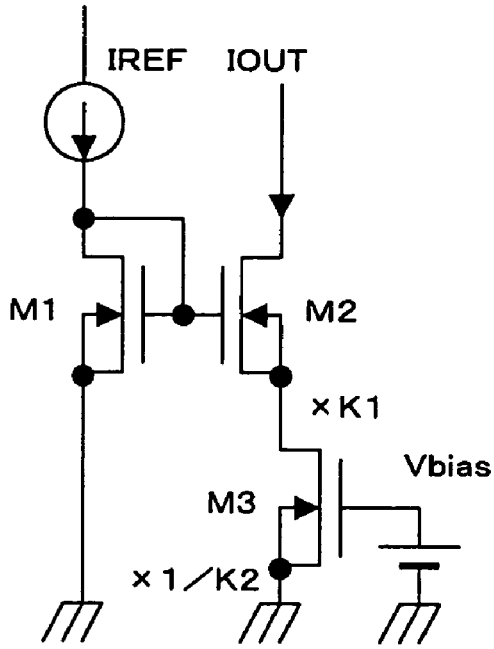
FIG. 2 is a diagram showing a configuration of other embodiment of the present invention.
Figure 21:
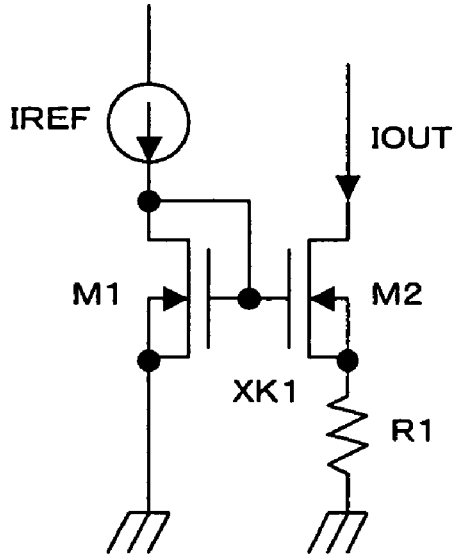
FIG . 21 PRIOR ART
FIG. 21 is a diagram showing a configuration of a conventional Widlar current mirror circuit.

FIG. 2 is a diagram showing a configuration of another embodiment according to the present invention. Referring to FIG. 2, a first transistor M1 and a second transistor M2 with gates thereof connected in common constitute the current mirror circuit. The source of the first MOS transistor M1 is directly grounded, and the source of the second MOS transistor M2 is grounded through a third MOS transistor M3. The source of the third MOS transistor M3 is directly grounded, and the drain of the third MOS transistor is connected to the source of the second MOS transistor M2. The gate of the third MOS transistor is connected to the bias voltage $V_{bias}$. The gate and drain of the first MOS transistor M1 are connected in common for input of current. The current is output from the drain of the second MOS transistor M2. It may be considered that the current mirror circuit shown in FIG. 2 constituted from the MOS transistors alone has an input-output characteristic in which as the input current increases, the output current gradually and monotonously increases almost to show a touch of saturation, as a Widlar current mirror circuit in FIG. 21. When a SPICE simulation is actually performed, its input-output characteristic can be confirmed.

Figure 3:
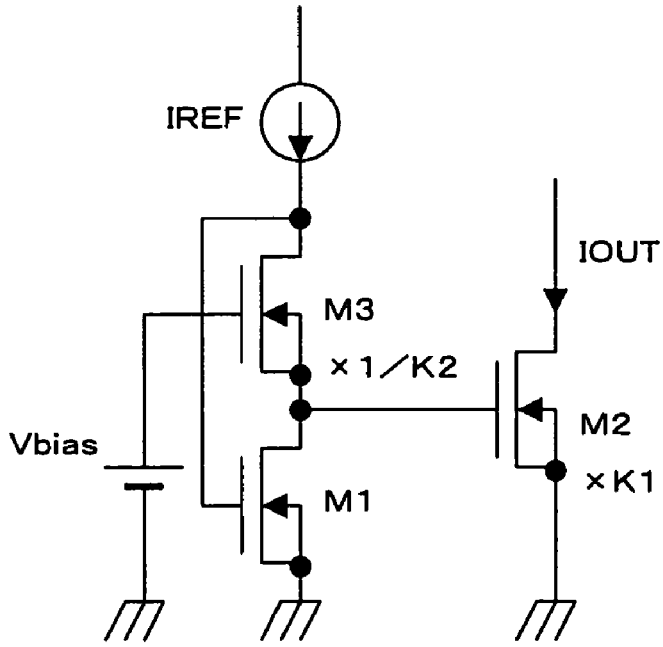
FIG. 3 is a diagram showing a configuration of still other embodiment of the present invention.
Figure 22:
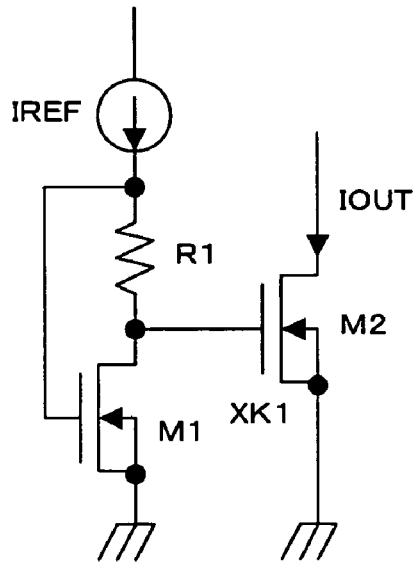
FIG . 22 PRIOR ART
FIG. 22 is a diagram showing a configuration of a conventional Nagata current mirror circuit.

FIG. 3 is a diagram showing a configuration of other embodiment of the present invention. Referring to FIG. 3, a first MOS transistor and a second MOS transistor with the drain of the first MOS transistor M1 connected in common to the gate of the second MOS transistor constitute the current mirror circuit. The source of the first MOS transistor M1 is directly grounded. The gate and drain of the first MOS transistor are connected through a third MOS transistor M3. The source of the third MOS transistor M3 is connected to the drain of the first MOS transistor M1. The drain of the third MOS transistor M3 is connected to the gate of the first MOS transistor M1. The gate of the third MOS transistor M3 is connected to the bias voltage $V_{bias}$. The source of the second MOS transistor M2 is directly grounded. Current is input to the drain of the third MOS transistor M3, and the electrical current is then output from the drain of the second MOS transistor M2. The current mirror circuit shown in FIG. 3 constituted from the MOS transistors alone may also be considered to have an input-output characteristic in which as the input current increases, the output current monotonously increases almost to show a touch of saturation as in a Nagata current mirror circuit in FIG. 22. When the SPICE simulation is actually performed, its input-output characteristic can be confirmed.

In FIG. 1, a description was directed to an example in which the MOS transistors M1, M2, and M3 are constituted from the n-channel MOS transistors. The same application is also made to a case where the MOS transistors M1, M2, and M3 are constituted from p-channel MOS transistors. In this case, however, the sources of the transistors M2 and M3 are connected to the power supply. The same also holds true for the embodiment shown in FIG. 2. In the case of FIG. 3, too, when the MOS transistors M1, M2, and M3 are constituted from the p-channel MOS transistors, the sources of the transistors M1 and M2 are connected to the power supply.

Next, a method of biasing the gate of the MOS transistor M3 in the MOS current circuits illustrated in FIGS. 1 through 3 will be specifically shown, and a circuit that replaces the voltage source $V_{bias}$ will be provided.

Figure 4:
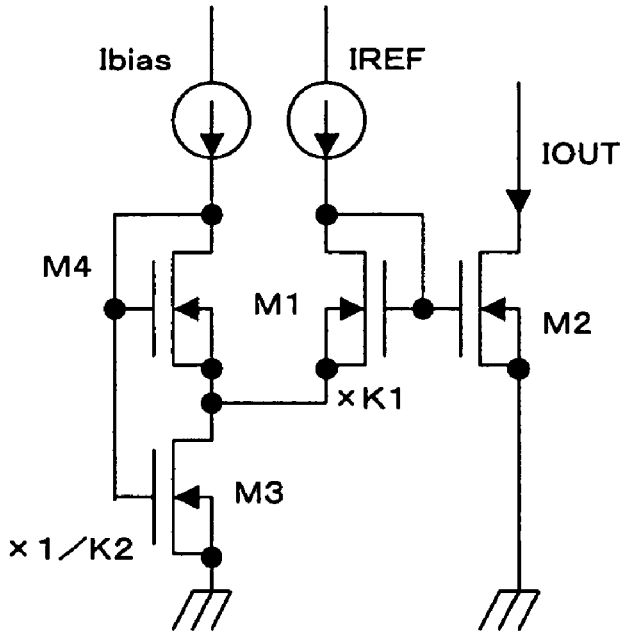
FIG. 4 is a diagram showing a configuration of other embodiment of the present invention.

In an example shown in FIG. 4, in order to bias the gate of the MOS transistor M3 of the reverse Widlar current mirror circuit shown in FIG. 1 constituted from the MOS transistors alone, an MOS transistor M4 and a current source $I_{bias}$ are added.

Referring to FIG. 4, the MOS transistors M1, M2, and M4 operate in the saturation region, while the MOS transistor M3 operates in the linear region. The drain currents $I_{D1}$, $I_{D2}$, $I_{D3}$, and $I_{D4}$ of the transistors M1, M2, M3 and M4 are expressed as follows, respectively:

$$I_{REF}=I_{D1}=K_1\beta(V_{GS2}-V_{S1}-V_{TH})^2 \tag{18}$$

$$I_{OUT}=I_{D2}=\beta(V_{GS2}-V_{TH})^2 \tag{19}$$

$$I_{REF}+I_{bias}=I_{D3}=2n(1/K_2)\beta\{(V_{GS3}-V_{TH})V_{S1}-nV_{S1}^2/2\} \tag{20}$$

$$I_{bias}=I_{D4}=\beta(V_{GS3}-V_{S1}-V_{TH})^2 \tag{21}$$

From Equation (21), the following equation is obtained:

$$V_{GS3}-V_{TH}=V_{S1}+\sqrt{\frac{I_{bias}}{\beta}} \tag{22}$$

When this equation is substituted into Equation (20) to solve $V_{S1}$, the following equation is obtained:

$$V_{S1}=\frac{1}{2-n}\left(\pm\sqrt{\frac{I_{bias}}{\beta}+\frac{K_2}{n\beta}(2-n)(I_{REF}+I_{bias})}-\sqrt{\frac{I_{bias}}{\beta}}\right) \tag{23}$$

Accordingly, when Equation (23) is substituted into Equation (22) and the resulting equation is further substituted into Equation (19), an output current $I_{OUT}$ is expressed as follows:

$$I_{out}=\left[\frac{1}{2-n}\left\{\pm\sqrt{I_{bias}+\frac{K_2}{n}(2-n)(I_{REF}+I_{bias})}-\sqrt{I_{bias}}\right\}+\sqrt{\frac{I_{REF}}{K_1}}\right]^2 \tag{24}$$

where between ±, + should be taken.

The right side of Equation (24) is squared. Accordingly, when terms in a bracket [ ] to be squared is expressed as $\sqrt{I_{REF}}$, the $I_{OUT}$ becomes proportional to the $I_{REF}$. The circuit therefore becomes a linear current mirror circuit. However, in Equation (24), the $I_{REF}$ is also included within the $\sqrt{}$ of a first term. Thus, the value within the bracket [ ] becomes larger than the $\sqrt{I_{REF}}$. In addition, when the $I_{REF}$ increases, the value within the $\sqrt{}$ of the first term including the $I_{REF}$ will monotonously increase. Accordingly, the value within the bracket [ ] in Equation (24) will monotonously become larger than the a $\sqrt{I_{REF}}$ when the $I_{REF}$ increases. Since the terms within the bracket [ ] in Equation (24) are squared, the $I_{OUT}$ will increase with an increase in the $I_{REF}$ in a square manner. More specifically, it can be seen that the characteristic of the well-known reverse Widlar current mirror circuit can be obtained.

Figure 5:
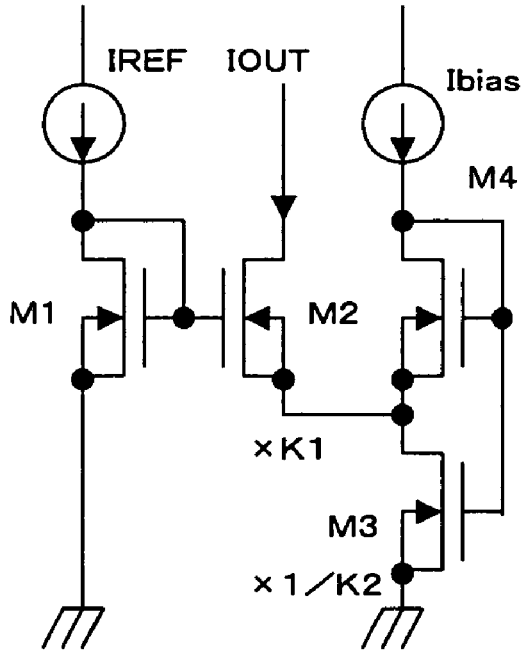
FIG. 5 is a diagram showing a configuration of other embodiment of the present invention.

FIG. 5 is a diagram showing a circuit configuration in which the MOS transistor M4 and the current source $I_{bias}$ are added so as to bias the gate of the MOS transistor M3 in a Widlar current mirror circuit shown in FIG. 2 constituted from the MOS transistors alone. Referring to FIG. 5, its operation will be described. Referring to FIG. 5, the MOS transistors M1 and M2, and M4 operate in the saturation region, while the MOS transistor M3 operates in the linear region. The drain currents $I_{D1}$, $I_{D2}$, $I_{D3}$, and $I_{D4}$ of the transistors M1, M2, M3 and M4 are expressed as follows, respectively:

$$I_{REF}=I_{D1}=\beta(V_{GS1}-V_{TH})^2 \tag{25}$$

$$I_{OUT}=I_{D2}=K_1\beta(V_{GS1}-V_{S1}-V_{TH})^2 \tag{26}$$

$$I_{OUT}+I_{bias}=I_{D3}=2n(1/K_2)\beta\{(V_{GS3}-V_{TH})V_{S1}-nV_{S1}^2/2\} \tag{27}$$

$$I_{bias}=I_{D4}=\beta(V_{GS3}-V_{S1}-V_{TH})^2 \tag{28}$$

From Equation (28), the following equation is obtained:

$$V_{GS3}-V_{TH}=V_{S1}+\sqrt{\frac{I_{bias}}{\beta}} \tag{29}$$

When this equation is substituted into Equation (27) and to work out $V_{S1}$, the following equation is obtained:

$$V_{S1}=\frac{1}{2-n}\left\{\pm\sqrt{\frac{I_{bias}}{\beta}+\frac{K_2}{n\beta}(2-n)(I_{OUT}+I_{bias})}-\sqrt{\frac{I_{bias}}{\beta}}\right\} \tag{30}$$

Accordingly, when Equation (30) is substituted into Equation (29) and the resulting equation is further substituted into Equation (26), the output current $I_{OUT}$ is given as follows:

$$I_{out}=K_1\left[\frac{1}{2-n}\left\{\pm\sqrt{I_{bias}+\frac{K_2}{n}(2-n)(I_{OUT}+I_{bias})}+\sqrt{I_{bias}}\right\}+\sqrt{\frac{I_{REF}}{K_1}}\right]^2 \tag{31}$$

Since analysis cannot be performed without alteration, the following expression in regard to the $I_{REF}$ is made:

$$I_{REF}=K_1\left[\frac{1}{2-n}\left\{\pm\sqrt{I_{bias}+\frac{K_2}{n}(2-n)(I_{OUT}+I_{bias})}-\sqrt{I_{bias}}\right\}+\sqrt{\frac{I_{OUT}}{K_1}}\right]^2 \tag{32}$$

where between ±, + should be taken.

The right side of Equation (32) is squared. Accordingly, when terms in the bracket [ ] to be squared are expressed as the $\sqrt{I_{REF}}$, the $I_{OUT}$ becomes proportional to the $I_{REF}$. The circuit therefore becomes the linear current mirror circuit.

However, in Equation (32), the $I_{out}$ is also included within the $\sqrt{}$ of the first term. Thus, the value within the bracket [ ] becomes larger than the a $\sqrt{I_{OUT}}$. In addition, when the $I_{OUT}$ increases, the value within the $\sqrt{}$ of the first term including the $I_{OUT}$ will monotonously increase. Accordingly, the value within the bracket [ ] will monotonously become larger than the a $\sqrt{I_{REF}}$ when the $I_{REF}$ increases. Since the terms within the bracket [ ] are squared, the $I_{REF}$ will increase with an increase in the $I_{OUT}$ in the square manner.

As described above, the output-input characteristic can be obtained. Accordingly, if an output-input relationship is inverted, it can be seen that as the input current $I_{REF}$ increases, the degree of the increase of the output current is gradually reduced, so that the characteristic of the well-known Widlar current mirror circuit can be obtained as the input-output characteristic.

Figure 6:
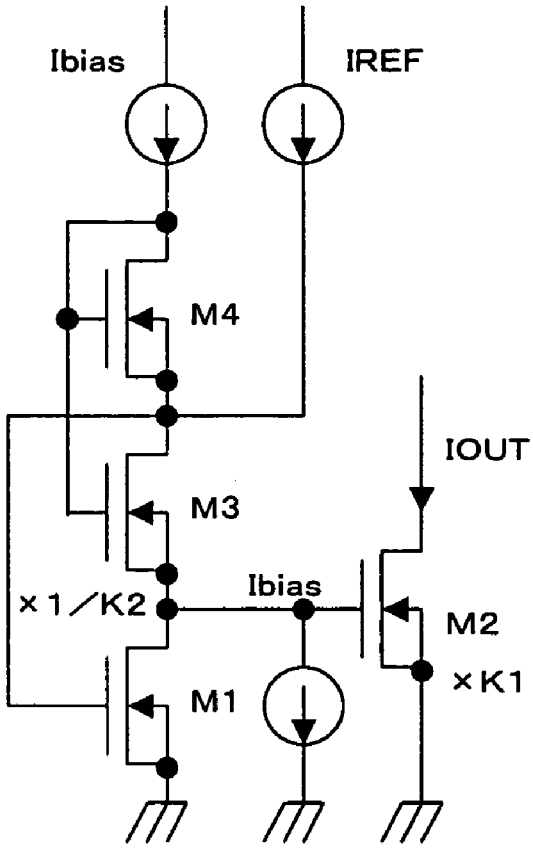
FIG. 6 is a circuit showing an embodiment of the present invention.

FIG. 6 is a diagram showing a circuit configuration in which the MOS transistor M4 and the current source $I_{bias}$ are added so as to bias the gate of the MOS transistor M3 of a Nagata current mirror circuit shown in FIG. 3 constituted from the MOS transistors alone. An operation of a circuit in FIG. 6 will be described.

Referring to FIG. 6, the MOS transistors M1, M2, and M4 operate in the saturation region, and the MOS transistor M3 operates in the linear region. To the current source $I_{bias}$ for biasing, another current source $I_{bias}$ is added so that electrical current is input from the MOS transistor M4 and then comes out through the MOS transistor M3. Through it, the electrical current is bypassed.

The drain currents $I_{D1}$, $I_{D2}$, $I_{D3}$, and $I_{D4}$ of the transistors M1, M2, M3 and M4 are expressed as follows, respectively:

$$I_{REF}=I_{D1}=\beta(V_{GS1}-V_{TH})^2 \tag{33}$$

$$I_{OUT}=I_{D2}=K_1\beta(V_{GS2}-V_{TH})^2 \tag{34}$$

$$I_{REF}+I_{bias}=I_{D3}=2n(1/K_2)\beta\{(V_{G3}-V_{GS2}-V_{TH})(V_{GS1}-V_{GS2})-n(V_{GS1}-V_{GS2})^2/2\} \tag{35}$$

$$I_{bias}=I_{D4}=\beta(V_{G3}-V_{GS1}-V_{TH})^2 \tag{36}$$

Likewise, when Equation (33) is used to work out $\sqrt{I_{OUT}}$ for Equation (36), the following equation is obtained:

$$\sqrt{I_{OUT}}=\sqrt{K_1}\left[\frac{\sqrt{I_{bias}}}{2-n}+\sqrt{I_{REF}}\pm\frac{\left(\sqrt{I_{bias}\left\{1+\frac{(2-n)K_2}{n}\right\}+I_{REF}(2-n)\left\{(2-n)-\frac{n(2-n)-K_2}{n}\right\}}\right)}{(2-n)}\right] \tag{37}$$

Further, when n is set to one, the following equation holds:

$$\sqrt{I_{OUT}}=K_1\{\sqrt{I_{bias}}+\sqrt{I_{REF}}\pm\sqrt{(1+K_2)I_{bias}+K_2I_{REF}}\} \tag{38}$$

In Equations (37) and (38), between ±,+ should be taken.

By squaring both sides of Equations (37) and (38), $I_{OUT}$ is obtained:

$$I_{OUT}=K_1\left[\frac{I_{bias}\left\{2+\frac{(2-n)K_2}{n}\right\}+I_{REF}(2-n)\left\{2(2-n)-\frac{n(2-n)-K_2}{n}\right\}}{(2-n)^2}+\frac{2}{2-n}\sqrt{I_{bias}I_{REF}}+\frac{2\sqrt{I_{REF}\left[I_{bias}\left\{1+\frac{(2-n)K_2}{n}\right\}+I_{REF}(2-n)\left\{(2-n)-\frac{n(2-n)-K_2}{n}\right\}\right]}}{2-n}+\frac{2\sqrt{I_{bias}\left[I_{bias}\left\{1+\frac{(2-n)K_2}{n}\right\}+I_{REF}(2-n)\left\{(2-n)-\frac{n(2-n)-K_2}{n}\right\}\right]}}{(2-n)^2}\right] \tag{39}$$

When n is set to one, the following equation is obtained:

$$I_{OUT}=K_1[(1+K_2)I_{REF}+(2+K_2)I_{bias}+2\sqrt{I_{bias}I_{REF}}+2\sqrt{I_{bias}}\{(1+K_2)I_{bias}+K_2I_{REF}\}+2\sqrt{I_{REF}}\{(1+K_2)I_{bias}+K_2I_{REF}\}] \tag{40}$$

Accordingly, consider Equation (40) when n is set to one, for simplicity. Then, a term of b $\sqrt{I_{REF}}$ is included in addition to a term of $aI_{REF}$. It is therefore clear that the $I_{OUT}$ is not proportional to the $I_{REF}$, so that the circuit becomes the non-linear current mirror circuit. The $I_{OUT}$ increases with an increase in the $I_{REF}$. When the input current $I_{REF}$ increases, however, the degree of the increase of the output current is gradually reduced due to the influence of the $\sqrt{}$ terms. It can be therefore seen that the characteristic similar to that of the well-known Widlar current mirror circuit can be obtained.

However, when the value of $1/K_2$ is reduced (or the $K_2$ is increased) and the current is increased, a secondary influence such as the influence of a voltage drop caused by a drain resistance or a source resistance begins to appear on the MOS transistor M3 initially. Then, in terms of the circuit, a gate-to-source voltage $V_{GS2}$ is more reduced than the value obtained by a circuit analysis described above, and the current that flows through the MOS transistor M2 as an output is gradually reduced. In other words, a well-known peaking characteristic will appear in the input-output characteristic.

That is, by setting the MOS transistor M3 to a small size, the Nagata current mirror circuit can be implemented. As is often said, the MOS transistor M3 which operates in the linear region can be regarded substantially as a resistance, from which as well, this can be intuitively understood.

Alternatively, practically, the MOS transistor M3 may also be regarded as the resistor that has a second-order dependence on voltage. However, apparently, the circuit analysis as shown above does not support this well-known proposition that "when the MOS transistor is operated in the linear region, the MOS transistor can be intuitively regarded as the resistor".

Figure 7:
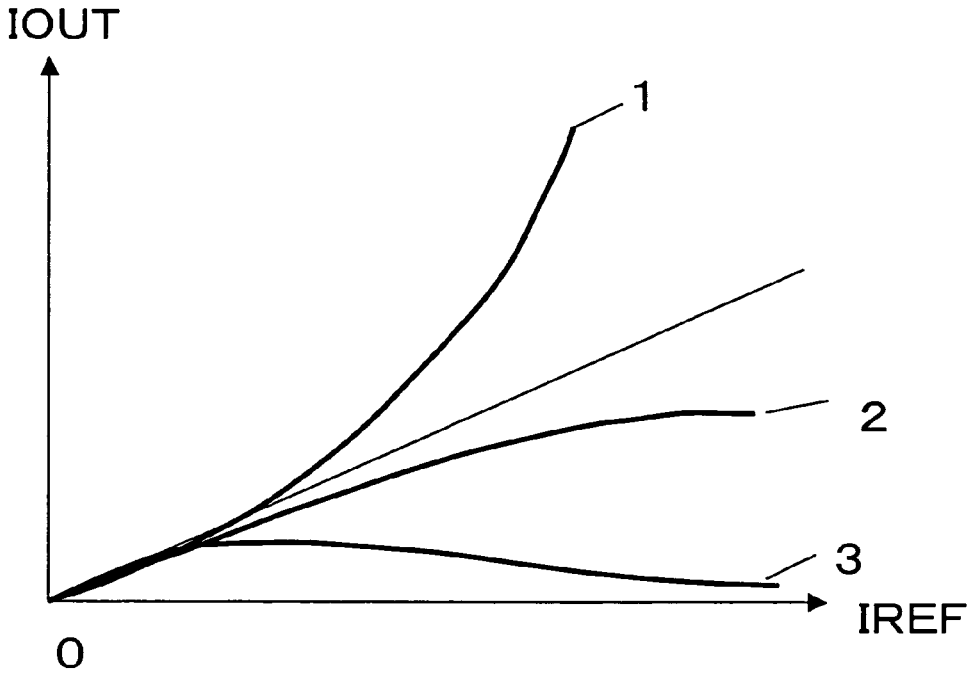
FIG. 7 is a graph schematically showing characteristics of circuits shown in FIGS. 1 to 6.

As described above, when the input-output characteristic of the current mirror circuit are summarized, three types of characteristics can be implemented as shown in FIG. 7. A horizontal axis indicates the $I_{REF}$, while a vertical axis indicates the $I_{OUT}$. Reference numerals 1, 2, and 3 in FIG. 7 indicate the input-output characteristics of the circuits in FIG. 1 (or FIG. 4), FIG. 2(or FIG. 5), and FIG. 3(or FIG. 6), respectively.

Further, in the circuit in FIG. 6, the current source $I_{bias}$ can be removed.

Figure 8:
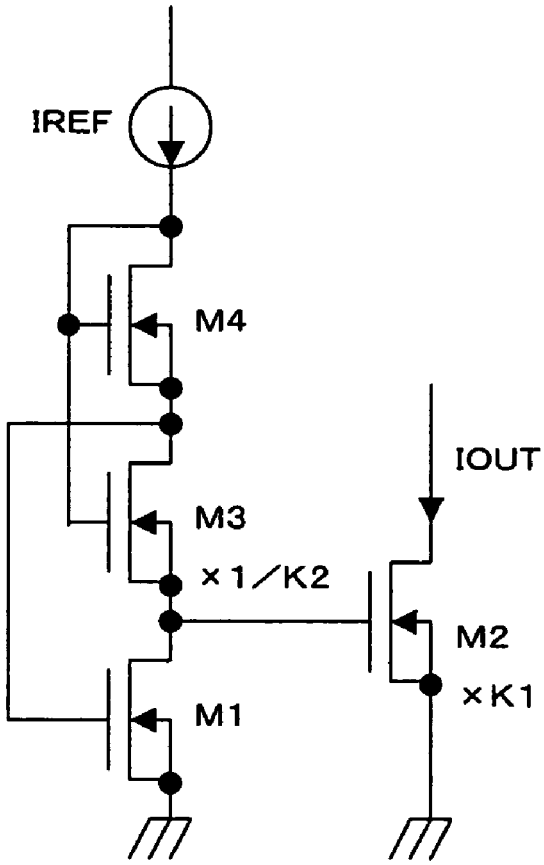
FIG. 8 is a diagram showing a configuration of still other embodiment of the present invention.

In a circuit in FIG. 8, the MOS transistors M1, M3, and M4 share the drain currents thereof, and the circuit is so configured that the current source $I_{bias}$ required for the circuits shown in FIGS. 4, 5, and 6 becomes unnecessary.

The drain currents $I_{D1}$, $I_{D2}$, $I_{D3}$, and $I_{D4}$ of the transistors M1, M2, M3 and M4 are expressed as follows, respectively:

$$I_{REF}=I_{D1}=\beta(V_{GS1}-V_{TH})^2 \tag{41}$$

$$I_{OUT}=I_{D2}=K_1\beta(V_{GS2}-V_{TH})^2 \tag{42}$$

$$I_{REF}=I_{D3}=2n(1/K_2)\beta\{(V_{G3}-V_{GS2}-V_{TH})(V_{GS1}-V_{GS2})-n(V_{GS1}-V_{GS2})^2/2\} \tag{43}$$

$$I_{REF}=I_{D4}=\beta(V_{G3}-V_{GS1}-V_{TH})^2 \tag{44}$$

From Equations (41) and (42), the following equation is obtained:

$$V_{GS3}-V_{GS2}=\sqrt{\frac{I_{REF}}{\beta}}-\sqrt{\frac{I_{OUT}}{K_1\beta}} \tag{45}$$

Likewise, the following equation is obtained:

$$V_{G3}-V_{GS2}-V_{TH}=2\sqrt{\frac{I_{REF}}{\beta}}-\sqrt{\frac{I_{OUT}}{K_1\beta}} \tag{46}$$

When Equations (45) and (46) are substituted into Equation (43) to work out $\sqrt{I_{OUT}}$, the following equation is obtained:

$$\sqrt{I_{OUT}}=\sqrt{K_1 I_{REF}}\left\{\frac{(3-n)\pm\sqrt{1+\frac{(2-n)K_2}{n}}}{2-n}\right\} \tag{47}$$

in which even when n is set to one, the $K_2$ becomes larger than three. Thus, between ±,+ should be taken.

Accordingly, the output current $I_{OUT}$ becomes as follows:

$$I_{OUT}=K_1 I_{REF}\left[\frac{(3-n)+\sqrt{1+\frac{(2-n)K_2}{n}}}{2-n}\right]^2 \tag{48}$$

When n is set to one, the following equation holds:

$$I_{OUT}=K_1 I_{REF}(2+\sqrt{1+K_2})^2 \tag{49}$$

Accordingly, consider Equation (49) when n is set to one, for simplicity. The right side of the equation is constituted from the term of a$I_{REF}$ alone, where a is a constant coefficient. The $I_{OUT}$ is therefore proportional to the $I_{REF}$. It means that the circuit becomes the linear current mirror circuit, so that the $I_{OUT}$ increases with an increase in the $I_{REF}$.

However, when the value of $1/K_2$ is reduced (or the $K_2$ is increased) and the current is increased, the secondary influence such as the influence of a voltage drop caused by the drain resistance or the source resistance begins to appear on the MOS transistor M3 initially. Then, in terms of the circuit, the $V_{GS2}$ is more reduced than the value obtained by the circuit analysis described above, and the current that flows through the MOS transistor M2 as an output is gradually reduced. In other words, the well-known peaking characteristic will appear in the input-output characteristic. That is, by setting the resistance of the MOS transistor M3 to a small value, the Nagata current mirror circuit can be implemented.

This state will be explained by showing the values of SPICE simulations in which L is set to 1.08 μm, W is set to 18 μm, ($k_1$ is set to four), and $k_2$ is set to three in the standard transistor size of the N-channel MOS transistors in a CMOS process using a 3.5-μm rule in FIG. 9.

The input-output characteristic having the peaking characteristic similar to that of the Nagata current mirror circuit is obtained. However, the current in the vicinity of the peak value has become a large current that has already exceeded 100 μA. In the transistor size of this level (at which the MOS transistor M3 has the L of 1.08 μm and the W of 6 μm), such a large current cannot be flown.

Accordingly, due to the secondary influence such as the influence of the drain resistance or source resistance, the circuit is considered to have the peaking characteristic similar to that of the Nagata current mirror circuit.

Figure 10:
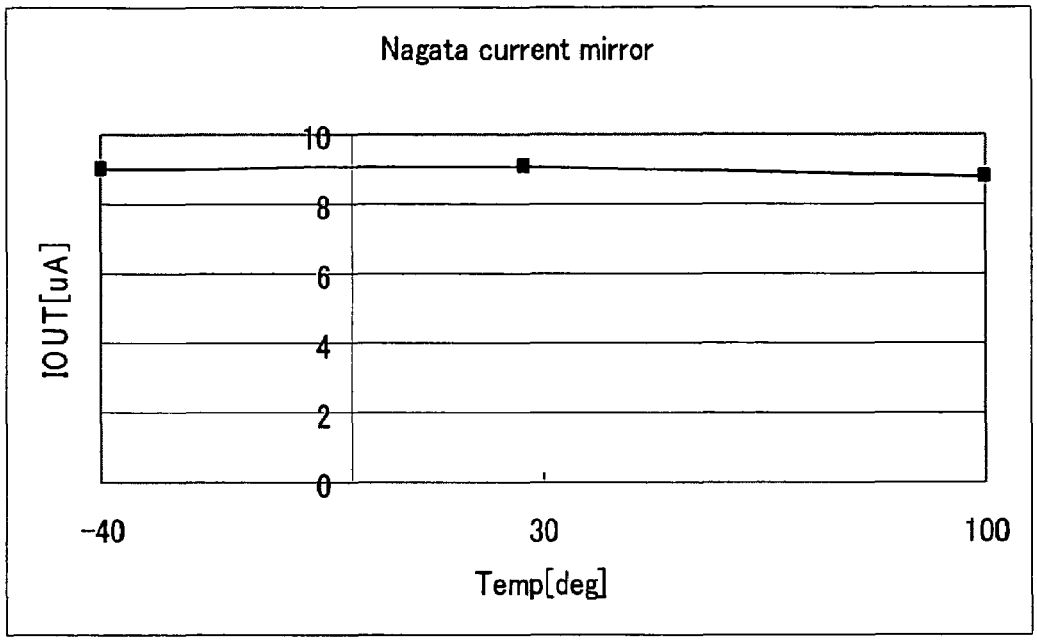
FIG. 10 is a graph showing a temperature characteristic of an output current of the circuit shown in FIG. 8.

Further, when the $I_{REF}$ is equal to 10 μA, the output current with a small temperature characteristic as shown in FIG. 10 is obtained by the SPICE simulation.

It can be further confirmed from the SPICE simulations that the temperature characteristics of the output currents of the MOS current mirror circuits shown in FIGS. 1 to 6 are also small values likewise.

From the results of the simulations thus obtained, it can be intuitively understood that, as is well said, a MOS transistor which is operated in the linear region may be regarded as substantially a resistor. Alternatively, the MOS transistor may be practically regarded as a resistor that has a second-order dependence on voltage. The circuit analysis of the MOS Nagata current mirror circuit described above, however, apparently does not support the well known proposition that "when the MOS transistor is operated in the linear region, the MOS transistor can be intuitively regarded as the resistor". In the SPICE simulations, however, the back gates of the N-channel transistors are directly connected to the substrate. Thus, in the strict sense, the simulations are more or less deviated from the circuit analysis described above. When the back gates of the N-channel MOS transistors are directly connected to the substrate, however, the circuit analysis cannot be performed.

Figure 11:
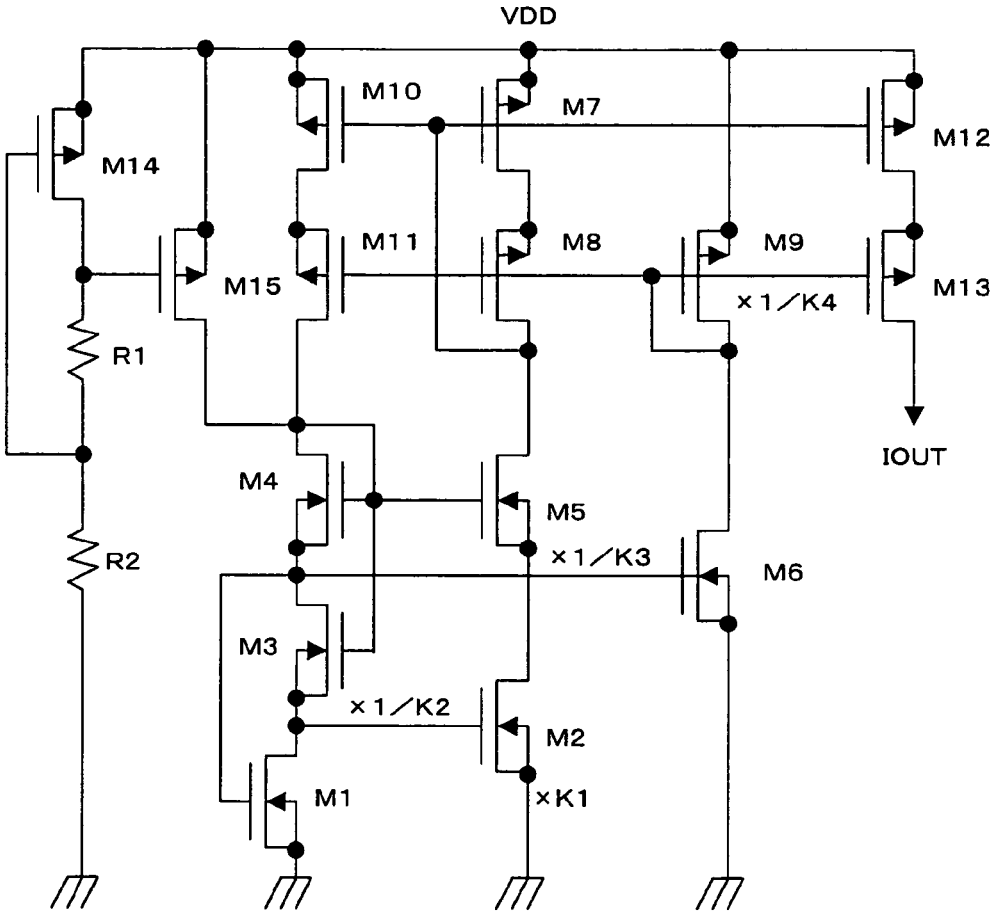
FIG. 11 is a diagram showing an example of a reference current circuit according to an embodiment of the present invention.

Next, a circuit shown in FIG. 11 will be described as an example representing a self-biased circuit. A driving side current mirror circuit is provided on the side of a power supply VDD so that the input side reference current $I_{REF}$ of the current mirror circuit shown in FIG. 8 is proportional to the output current $I_{OUT}$ of the current mirror circuit shown in FIG. 8, for self-biasing. Herein, in order to reduce the influence of channel length modulation of the MOS transistor, a cascode current mirror circuit is adopted. For this reason, in order to bias cascode transistors, an MOS transistor M6 is added, thereby driving a diode-connected MOS transistor M9 with a current substantially equal to that for the MOS transistor M1. When cascode transistors constituting a one-to-one ratio current mirror circuit has the equal transistor size (herein being equivalent to a unit transistor), a transistor size $1/K_4$ of the MOS transistor M9 is generally set to 1/4. Further, in order to prevent the drain voltage of the MOS transistor M2 being greatly different from that of MOS transistor M1, an MOS transistor M5 is inserted into the cascode, thereby making the drain voltage of the MOS transistor M2 substantially constant. In FIG. 11, the Nagata current mirror circuit constituted from MOS transistors M14 and M15 and resistors R1 and R2 is added to serve as a start-up circuitry. Both of the resistors R1 and R2 are, however, just circuits for activating the self-biased reference current so that the circuit operates at a predetermined operating point without being involved in determination of the characteristic of the reference current circuit, or specifically the value of an output current.

Referring to FIG. 11, an MOS transistor M14 (with W/L being 2 μm/0.36 μm), an MOS transistor M15 (with W/L being 2 μm/0.36 μm), the resistor R1 (30 kΩ), and the resistor R2 (40 kΩ) constitute the start-up circuitry. This start-up circuitry makes a current mirror circuit (made up from the MOS transistors M1, M2, M3, and M4) that constitute a circuit to be started, reach a predetermined operating point upon power-up. The MOS transistors M1, M2, M3, and M4 in FIG. 11 correspond to the MOS transistors M1, M2, M3, and M4 in FIG. 8, respectively. A drain current $I_{D2}$ of the MOS transistor M2 given by Equation (48) described above, for example, is supplied to the transistor M8 of the cascode current mirror. Then, the output current $I_{OUT}$ is extracted from the MOS transistor M13.

Figure 9:
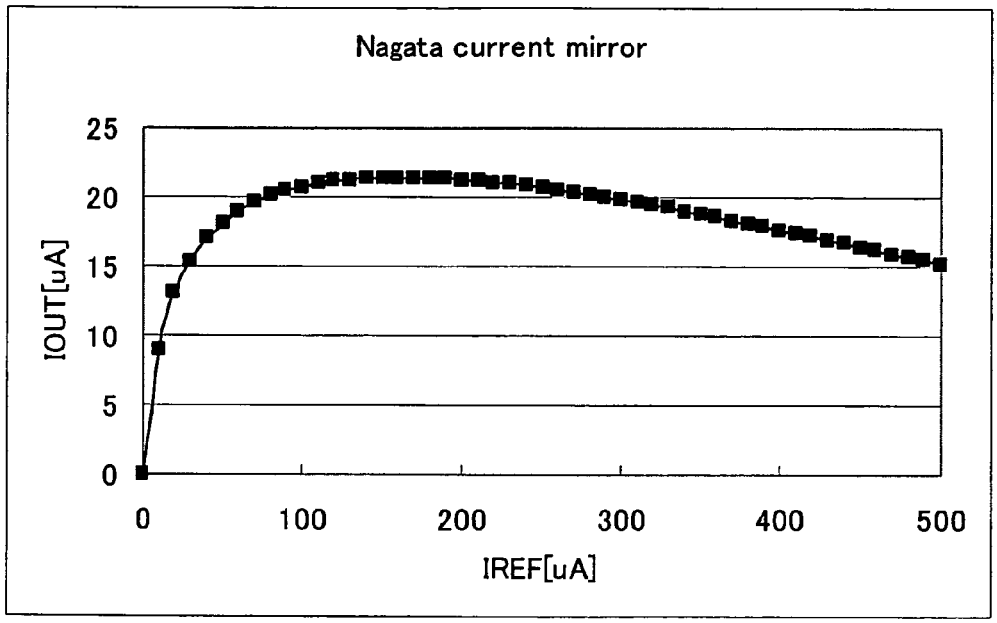
FIG. 9 is a graph showing input-output characteristics of a circuit shown in FIG. 8.

The MOS transistors M1 and M2 are not employed in the vicinity of the peak value of the peaking characteristic nor in an operating region of a monotonous decrease, but employed in the operating region of a monotonous increase in an input-output characteristic diagram shown in FIG. 9.

In the reference current circuit in FIG. 11, in the CMOS process using the 3.5 μm-rule, as the standard transistor size of the P-channel MOS transistors, the L is set to 1.08 μm, the W is set to 40.5 μm and as the standard transistor size of the N-channel MOS transistors, the L is set to 1.08 μm, and the W is set to 18 μm, the $K_2$ is set to 3, and $K_3$ is set to 4. Consideration is given so that the drain voltages of the MOS transistors M1 and M2 become substantially equal, thereby preventing the influence of the channel length modulation of the MOS transistors from appearing.

Further, in order to cause the circuit to operate at the supply voltage exceeding more or less 2V, the diode-connected MOS transistor M9 (with the $1/K_4$ being 1/4, and with the W/L ratio thereof being $1/K_4$, in which the $K_4$ is equal to three, for example) is added so as to bias the respective gates of the cascode stage transistor M8 and a cascode stage transistor M10 of the cascode current mirror circuit (constituted from the MOS transistors M7, M8, and M10 and an MOS transistor M11). The drain of the MOS transistor M9 is connected to the drain of the MOS transistor M6 that constitutes a constant current source with the source thereof grounded. In the example shown in FIG. 11, the gate voltage of the MOS transistor M6 is equal to the gate voltage of the MOS transistor M1. In the case of the current mirror circuit of one stage without using the cascode current mirror circuits of two stages (constituted from the MOS transistors M7, M8, M10, and M11 and MOS transistors M12 and M13), the transistors M9 and M6 are not of course required.

Figure 12:
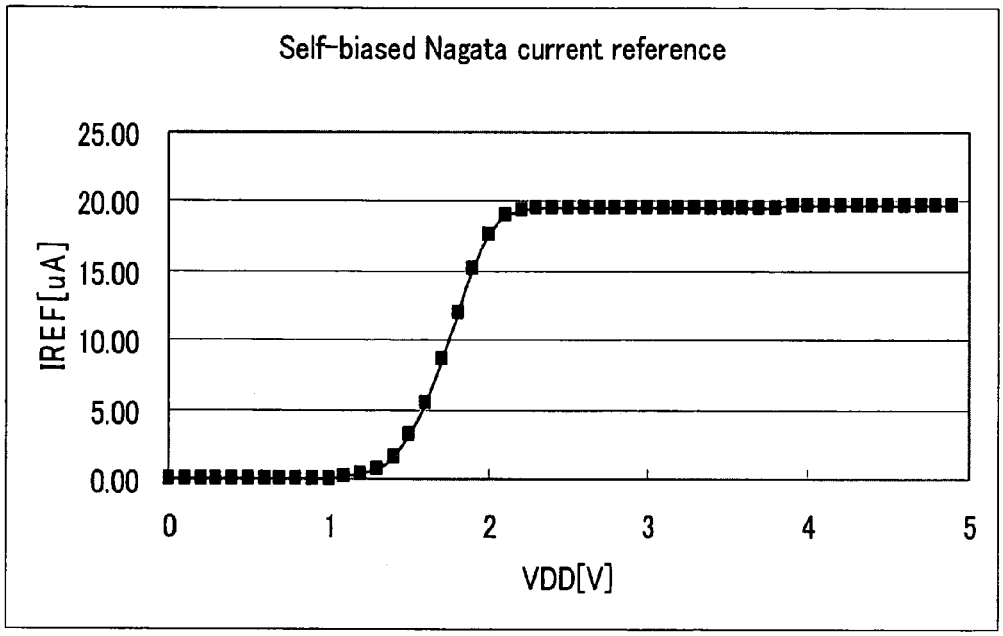
FIG. 12 is a graph showing an output characteristic when the supply voltage of the circuit shown in FIG. 11 has been changed.
Figure 13:
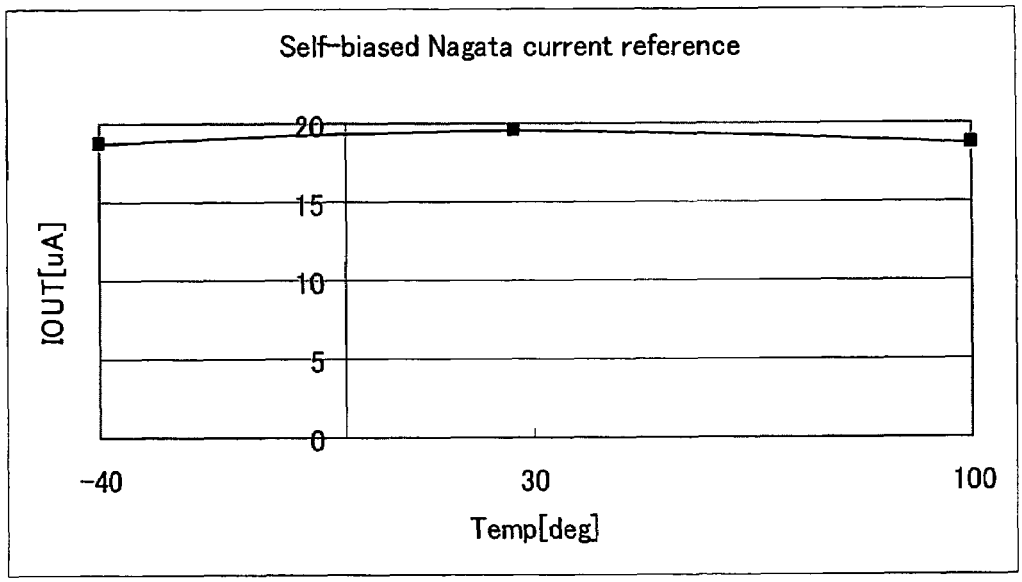
FIG. 13 is a graph showing the temperature characteristic of an output current of the circuit shown in FIG. 11.

The characteristic of an output current obtained by the SPICE simulation in which the supply voltage is changed is shown in FIG. 12, while the temperature characteristic of the output current obtained by the SPICE simulation is shown in FIG. 13. The reference current with a small change in the characteristics thereof with respect to a variation in the supply voltage and a small temperature characteristic is obtained.

The result of the simulation thus obtained can be intuitively understood from the proposition in which, as is well said, the MOS transistor M3 which operates in the linear region may be regarded substantially as the resistor. Alternatively, the MOS transistor may be practically regarded as the resistor that has a second-order dependence on voltage. The circuit analysis of the self-biased Nagata MOS current mirror circuit described above, however, apparently does not support the well known proposition that "when the MOS transistor is operated in the linear region, the MOS transistor can be intuitively regarded as the resistor". Alternatively, from the circuit analysis expression as to the self-biased MOS Nagata current mirror circuit described above, it cannot be known how the value of the current for the circuit is determined. However, as the SPICE simulation results support, by regarding the MOS transistor M3 that operates in the linear region substantially as the resistor, this can be understood by analogy from the reference current circuit of a self-biasing Nagata current mirror circuit type obtained by self-biasing a conventional Nagata current mirror circuit shown in FIG. 22 that employs the resistance.

In addition, in the SPICE simulations, the back gates of the N-channel MOS transistor are directly connected to the substrate. Thus, in the strict sense, the simulations are more or less deviated from the circuit analysis described above. Specifically, when the back gates of the N-channel MOS transistor are directly connected to the substrate, the output current will become more or less below 20 μA as shown in FIGS. 12 and 13. When the back gates of the N-channel MOS transistor are directly connected to the sources thereof, the output current will more or less exceed 10 μA. More specifically, the obtained reference current values will become different substantially by a factor of two. However, when the back gates of the N-channel MOS transistors are directly connected to the substrate, the analysis cannot be performed.

It goes without saying that even when the MOS current mirror circuits shown in FIGS. 1 to 6 are self-biased, the reference current of which the temperature characteristic is small can be obtained.

Needless to say, by inserting the resistor R1 (of 10 kΩ, for example), the reference current $I_{REF}$ is converted into a reference voltage, and the reference voltage circuit can be obtained. However, if a resistor is inserted, the reference voltage with a less variation cannot be obtained, because an element variation and manufacturing variations of the (MOS) transistor devices and the resistance elements that have been hitherto discussed are considered to be independent to one another.

Figure 14:
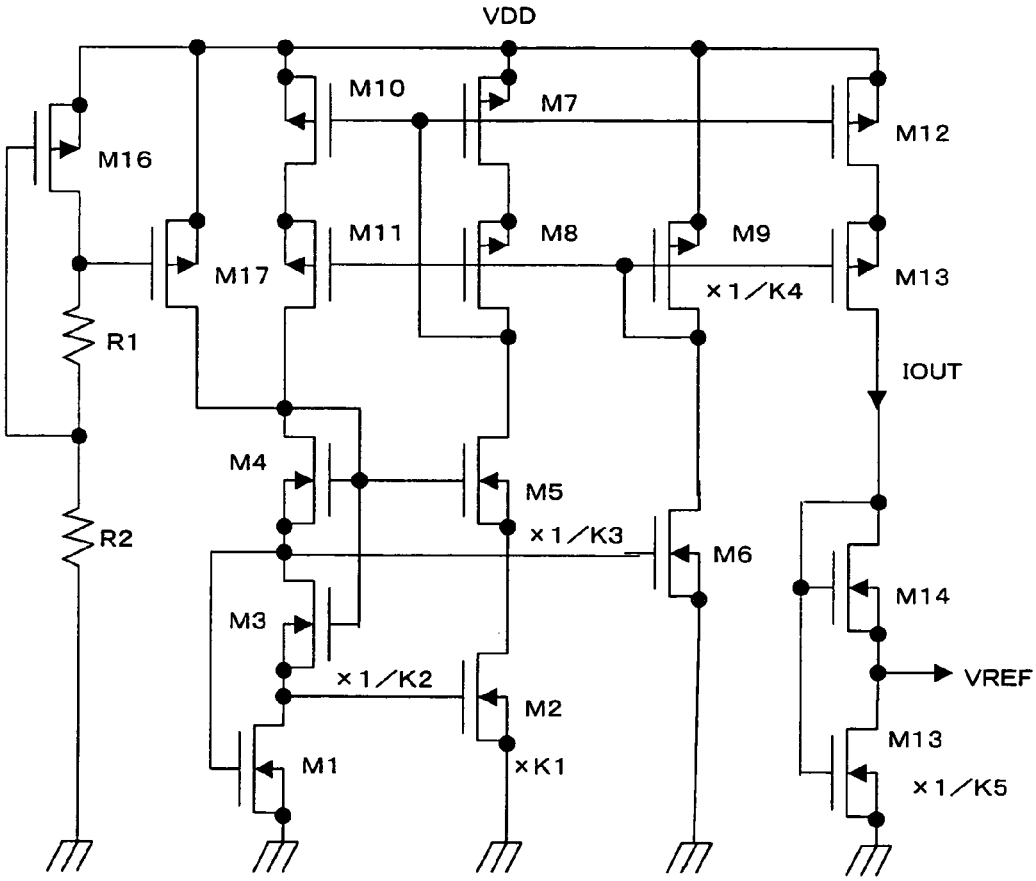
FIG. 14 is a diagram showing an example of a reference voltage circuit according to an embodiment of the present invention.

Accordingly, herein, by inserting the same circuit as the one constituted from the cascode transistors M3 and M4 between an output node (the drain of the MOS transistor M13) of the reference current circuit and the ground and driving the circuit thus inserted by the output current ($I_{OUT}$), the reference voltage circuit is obtained. FIG. 14 shows a configuration of the reference voltage circuit thus obtained.

An operation of the self-biasing reference voltage circuit shown in FIG. 14 is explained by setting the $I_{REF}$ to be equal to the $I_{OUT}$ in the current mirror circuit shown in FIG. 8.

That is, from Equation (49), setting as follows needs to be performed:

$$K_1(2+\sqrt{1+K_2})^2=1 \tag{50}$$

Further, in regard to the MOS transistors M15 and M14, the following equations hold:

$$I_{OUT}=I_{D14}=2n(1/K_5)\beta\{(V_{GS14}-V_{TH})V_{REF}-nV^2_{REF}/2\} \tag{51}$$

$$I_{OUT}=I_{D15}=\beta(V_{GS14}-V_{REF}-V_{TH}))^2 \tag{52}$$

When the square root of both sides of Equation (52) are applied and substitution into Equation (51) is performed to eliminate $V_{GS14}$, a second-order equation (53) with regard to $V_{REF}$ is obtained:

$$\left(1-\frac{n}{2}\right)V_{REF}^2+\sqrt{\frac{I_{OUT}}{\beta}}\,V_{REF}-\frac{K_5}{2n\beta}I_{OUT}=0 \tag{53}$$

When the $V_{REF}$ is worked out from Equation (53), the following equation is obtained:

$$V_{REF}=\frac{\sqrt{\frac{I_{OUT}}{\beta}}\left(-1\pm\sqrt{1-K_5+\frac{2K_5}{n}}\right)}{2-n} \tag{54}$$

where n is equal to or larger than one but smaller than 2. Thus, in order to make $V_{REF}$ positive (larger than zero), + should be taken, between ±.

Accordingly, when n is one, the following equation holds:

$$V_{REF}=\sqrt{\frac{I_{OUT}}{\beta}}\left(-1+\sqrt{1+K_5}\right) \tag{55}$$

However, the above-mentioned Equation (55) shows that the temperature characteristic of the reference voltage $V_{REF}$ obtained from the reference voltage circuit shown in FIG. 14 that does not depend on resistance is not canceled out when the temperature characteristic of the output current $I_{OUT}$ is not equal to a mobility temperature characteristic.

According to the results of the SPICE simulations, the output current $I_{OUT}$ of the reference current circuit shown in FIG. 13 has little temperature characteristic. In this case, when the reference voltage circuit shown in FIG. 14 is configured, the temperature characteristic of the reference voltage $V_{REF}$ becomes inverse to the mobility temperature characteristic, and becomes approximately a half of the mobility temperature characteristic, according to Equation (55). That is, assuming that the mobility temperature characteristic is approximately −5000 ppm/° C., the temperature characteristic of the reference voltage $V_{REF}$ becomes approximately 2500 ppm/° C. Thus, it can be seen that the reference voltage $V_{REF}$ has a positive temperature characteristic.

Figure 15:
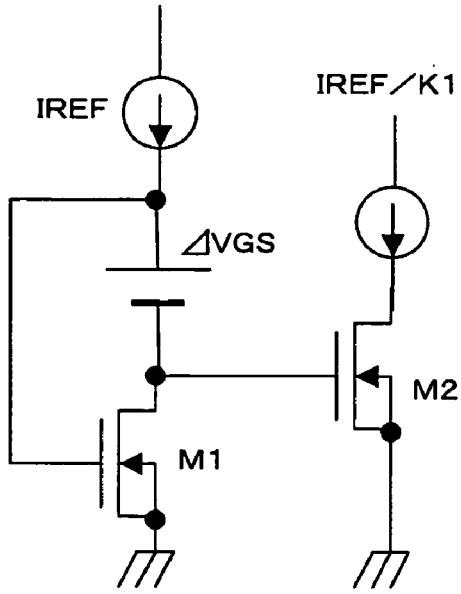
FIG. 15 is a diagram for explaining an operation of the circuit shown in FIG. 14.

Then, the circuit in FIG. 8 is transformed into a schematic form as shown in FIG. 15. The MOS transistor M2 is set to the unit transistor and is set to have the same size as the MOS transistor M1. Referring to FIG. 8, the MOS transistor M2 was set to have the transistor size of the unit transistor by a factor of $K_1$, so that the current by a factor of the $K_1$ was set to flow through the MOS transistor M2. In FIG. 15, the MOS transistor M2 is set to the unit transistor, and the current by a factor of $1/K_1$ is set to flow through the MOS transistor M2. A relationship between a drain current $I_D$ and a gate-to-source voltage $V_{GS}$ in this case will be shown in FIG. 16.

Figure 16:
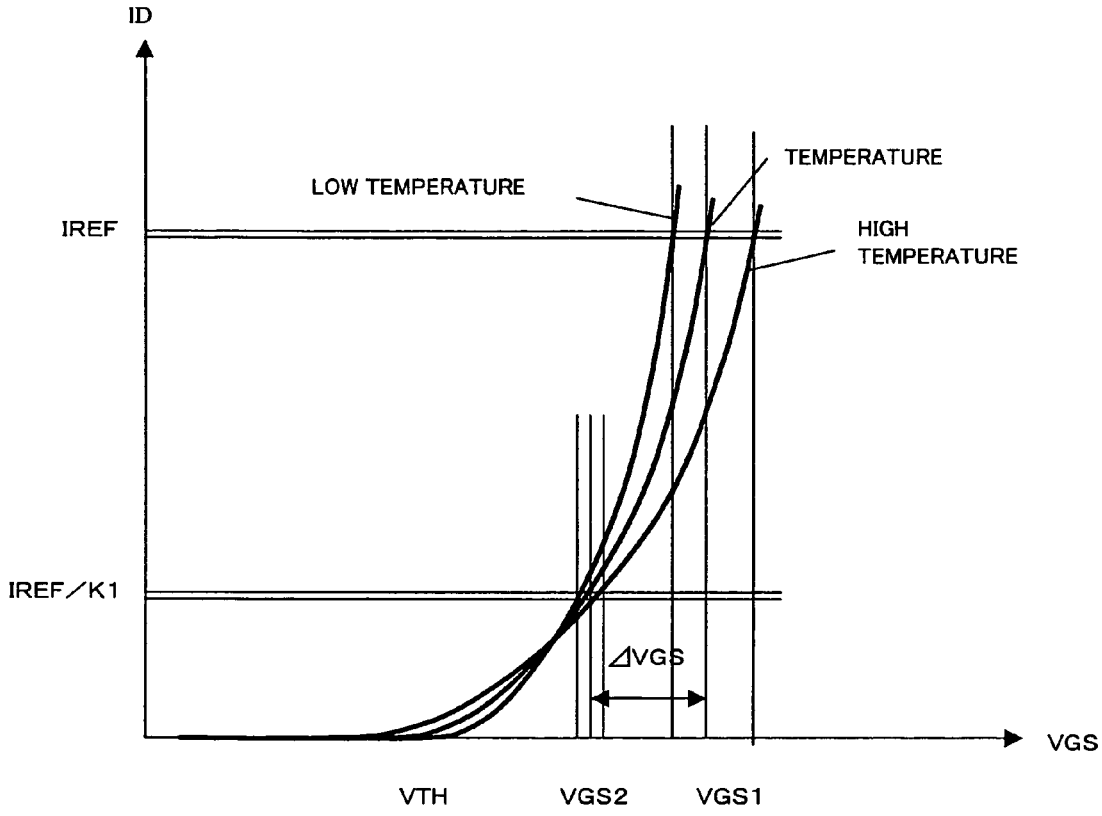
FIG. 16 is a schematic diagram for explaining characteristics of the circuit shown in FIG. 15.

With respect to the drain current of the MOS transistor (unit transistor), due to a relationship between the mobility temperature characteristic (negative temperature characteristic) and the temperature characteristic (negative temperature characteristic) of a threshold voltage $V_{TH}$, the gate-to-source voltage $V_{GS}$ at which the drain current becomes substantially constant without depending on temperature is present, as shown in FIG. 16. The temperature characteristics in FIG. 16 reflect the results of the SPICE simulations. The results of the SPICE simulations show that $\Delta V_{GS}$ has the positive temperature characteristic when the $I_{REF}$ (=$I_{OUT}$) has little temperature characteristic. However, from FIG. 16, it can be seen that by changing the transistor size of the MOS transistor M2, the temperature characteristic of this $\Delta V_{GS}$ can be changed. That is, it can be expected that when the value of $K_2$ is reduced (the value of the $\Delta V_{GS}$ is reduced according to the square characteristic of the MOS transistor), the temperature characteristic of the $\Delta V_{GS}$ is reduced. It can also be expected that when the value of the $K_2$ is increased (the value of the $\Delta V_{GS}$ is increased according to the square characteristic of the MOS transistor), the temperature characteristic of the $\Delta V_{GS}$ is increased.

As a result, when the temperature characteristic of the $\Delta V_{GS}$ is reduced, the temperature characteristic of the output current $I_{OUT}$ (=$I_{REF}$) changes so that it has a negative temperature characteristic. On the contrary, when the temperature characteristic of the $\Delta V_{GS}$ is increased, the temperature characteristic of the output current $I_{OUT}$ (=$I_{REF}$) changes so that it has the positive temperature characteristic. Accordingly, when the value of $K_2$ is reduced to be smaller than three set in the SPICE simulations, the temperature characteristic of the $\Delta V_{GS}$ is reduced, so that the temperature characteristic of the output current $I_{OUT}$ (=$I_{REF}$) has the negative temperature characteristic. It can be seen from Equation (55) that when the temperature characteristic of the output current $I_{OUT}$ becomes equal to the mobility temperature characteristic of approximately −5000 ppm/° C., the temperature characteristic of the reference voltage $V_{REF}$ is canceled out.

That is, even in the reference voltage circuit shown in FIG. 15 which does not depend on the resistance, by setting the transistor size ratio $K_2$ of the MOS transistor M2, the temperature characteristic of the reference voltage $V_{REF}$ can be set to be positive, negative, or scarcely zero.

Further, an operation of other reference current circuit that can be implemented by the MOS transistors alone will be described in detail even if the circuit is a special example in which the MOS transistors M1 and M2 are operated in weak inversion. The reason why the MOS transistors M1 and M2 are operated in weak inversion is to cause an exponential characteristic to be implemented in a V-I characteristic in the MOS transistors M1 and M2, as in bipolar transistors.

It is because by implementing the exponent characteristic, the positive temperature characteristic (of the Widlar current mirror circuit and the Nagata current mirror circuit) or the negative temperature characteristic (of the reverse Widlar current mirror circuit) that is the same as that of the conventional nonlinear current mirror circuit implemented by the bipolar transistors can be implemented in the nonlinear current mirror circuit constituted from two transistors.

It is because, in the V-I characteristic, the exponential characteristic changes more greatly than the square characteristic, so that a change in voltage with respect to a change in current is reduced in a logarithmic function, and a voltage temperature characteristic (about which the negative temperature characteristic of −1.9 mV/° C. of a base-emitter voltage ($V_{BE}$) in the bipolar transistor is well known) dominantly determines the temperature characteristic of the input-output characteristics of the current mirror circuit.

On the contrary, in the MOS transistor that operates in the saturation region in which the V-I characteristic thereof become the square characteristic(current varies as the square of voltage), a change in voltage with respect to a change in current can be reduced by a square root (√) characteristic alone, at most. Thus, the temperature dependency of the input-output characteristic of the current mirror circuit cannot be dominantly determined by the voltage temperature characteristic (negative temperature characteristic of the gate-to-source voltage ($V_{GS}$) of the MOS transistor).

Figure 17:
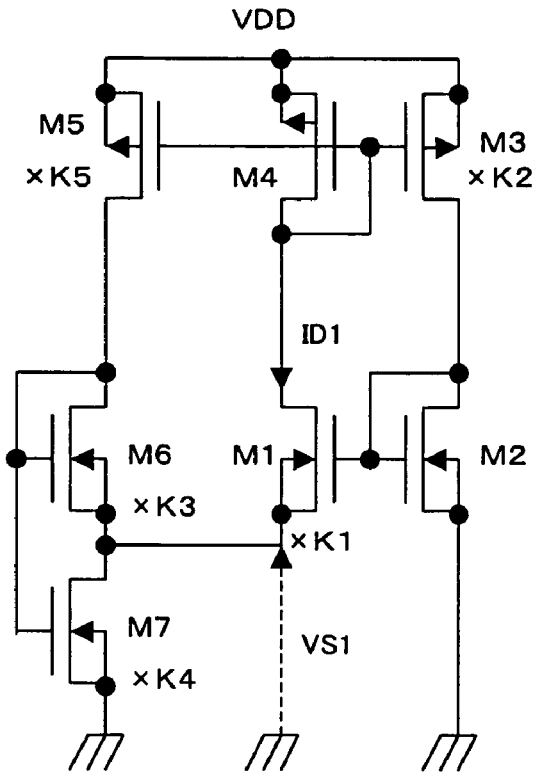
FIG. 17 is a diagram showing an example of a reference current circuit according to other embodiment of the present invention.

FIG. 17 is a diagram showing a configuration of a CMOS reference current circuit according to an embodiment of the present invention. Both of MOS transistors M1 and M2 that constitute the current mirror circuit operate in a weak inversion region. The MOS transistor M1 and the MOS transistor M2 constitute the nonlinear current mirror circuit in which a current flow from the MOS transistor M1 to the power supply is performed through the MOS transistor M7 that operates in the linear region, and a current flow from the MOS transistor M2 to the power supply is directly performed. The source of the MOS transistor M7 is connected to the ground. The drain of the MOS transistor M7 is connected in common to the source of the MOS transistor M1 and the source of the diode-connected MOS transistor M6. The gate of the MOS transistor M7 is connected to the gate of the MOS transistor M6. The MOS transistors M1, M2, and M6 are driven respectively by currents that are proportional to one another. The MOS transistors M4 and M3 constitute the current mirror circuit with a current ratio of one to $K_2$, while the MOS transistors M4 and M5 constitutes the current mirror circuit with a current ratio of one to $K_5$.

The reference current circuit according to the present embodiment is also implemented by the simplest circuit form or in the circuit form in which the nonlinear current mirror circuit is self-biased. As described above, in the self-biasing type reference current circuit, the start-up circuitry is always necessary. However, in this diagram, the start-up circuitry is omitted. When it is assumed that the transconductance parameter ratio of the MOS transistor M1 to the MOS transistor M2 is $K_1$ to one and that the MOS transistors M1 and M2 operate in weak inversion, a source voltage $V_{S1}$ of the MOS transistor M1 is likewise expressed as follows:

$$V_{S1}=V_r 1n(K_1K_2) \tag{56}$$

The transconductance parameter ratio of the MOS transistor M6 to the transistor M7 with respect to the unit transistor M2 used as a reference is $K_3$ to $K_4$, and the MOS transistors M6 and M7 operate in the saturation region and the linear region, respectively. The MOS transistors M6 and M7 are cascode-connected.

Since the MOS transistors M4 and M5 constitute the current mirror circuit with a current ratio of one to $K_5$, the drain current that is $K_5$ times as large as the drain current $I_1$ flows through the MOS transistor M6. The drain current that is ($K_5$+1) times as large as the drain current $I_{D1}$ flows through the MOS transistor M7. Accordingly, The drain currents $I_{D6}$ and $I_{D7}$ of MOS transistors M6 and M7 are given as follows:

$$I_{D6}=K_5I_{D1}=K_3\beta(V_{GS7}-V_{S1}-V_{TH})^2 \tag{57}$$

$$I_{D7}=(K_5+1)I_{D1}=2nK_4\beta\{(V_{GS7}-V_{TH})V_{S1}-nV_{S1}^2/2\} \tag{58}$$

When Expression (57) is substituted into Expression (58) for solution of this, the following equation is obtained:

$$I_{D1}=\frac{2n^2K_4^2K_5\beta V_{S1}^2}{K_3(K_5+1)^2}\left(1+\frac{K_3(K_5+1)(2-n)}{2nK_4K_5}\pm\sqrt{1-\frac{K_3(K_5+1)(2-n)}{nK_4K_5}}\right) \tag{59}$$

When Expression (56) is substituted into Equation (59), the following equation is obtained:

$$I_{D1}=\frac{2n^2K_4^2K_5\beta V_r^2\{\ln(K_1K_2)\}^2}{K_3(K_5+1)^2}\left(1+\frac{K_3(K_5+1)(2-n)}{2nK_4K_5}\pm\sqrt{1-\frac{K_3(K_5+1)(2-n)}{nK_4K_5}}\right) \tag{60}$$

The temperature characteristic of a transconductance parameter β is expressed as follows due to:

$$\mu=\mu_0\left(\frac{T_0}{T}\right)^m \qquad \beta=\beta_0\left(\frac{T_0}{T}\right)^m \tag{61}$$

where m assumes the value between 1.5 and two (1.5<m<2).

Accordingly, the following equation is obtained:

$$I_{D1}=\frac{2n^2K_4^2K_5}{K_3(K_5+1)^2}\beta_0\left(\frac{T}{T_0}\right)^{2-m}\frac{k^2}{q^2}\{\ln(K_1K_2)\}^2\left(1+\frac{K_3(K_5+1)(2-n)}{2nK_4K_5}\pm\sqrt{1-\frac{K_3(K_5+1)(2-n)}{nK_4K_5}}\right) \tag{62}$$

In the above-mentioned Equations (59), (60), and (62), a symbol ± is used so that the solutions of the equations can be traced. Referring to FIG. 17, it can be seen that as the $K_4$ increases, the current $I_{D1}$ will increase. Thus, it is appropriate to replace the symbol ± by a + symbol. Accordingly, the current $I_{D1}$ has the positive temperature characteristic. That is, the CMOS reference current circuit having a PTAT (proportional to absolute temperature) characteristic can be obtained.

As described above, the reference current circuit is constituted from the MOS transistors alone, without using resistance elements. Thus, the element variation occurs in the MOS transistors alone. The need for considering the element variation among the resistance elements is eliminated, so that the deviation of the variation can be correspondingly reduced.

As described above, analysis of the circuit was performed on the assumption that the MOS transistors M1 and M2 operate in weak inversion. The exponential characteristic that is substantially the same as that of the bipolar transistors is obtained when the MOS transistors are operated in weak inversion. Thus, it goes without saying that in the case of a Bi-CMOS process, even if these two MOS transistors M1 and M2 are replaced by the bipolar transistors, respectively, the same characteristic can be obtained. The configuration shown in FIG. 17 coincides with that of FIG. 9 of the Patent Document 4 in a circuit topology. They are, however, different in following respects. While the transistor size ratio of transistors NM3 and NM4' in FIG. 9 in the above-mentioned Patent Document 4 is set to $K_2$ to $K_2$+2 (and the transistor size ratio of transistors MN1 and MN3 is set to one to K2), the transistor size ratio of the transistors M6 and M7 in FIG. 17 is set to $K_3$ to $K_4$, and the transistor size ratio of the transistors M6 and M7 can be set arbitrarily. Further, while the Patent Document 4 provides the reference current circuit having little temperature characteristic, the $I_{D1}$ in FIG. 17 has the positive temperature characteristic.

Figure 18:
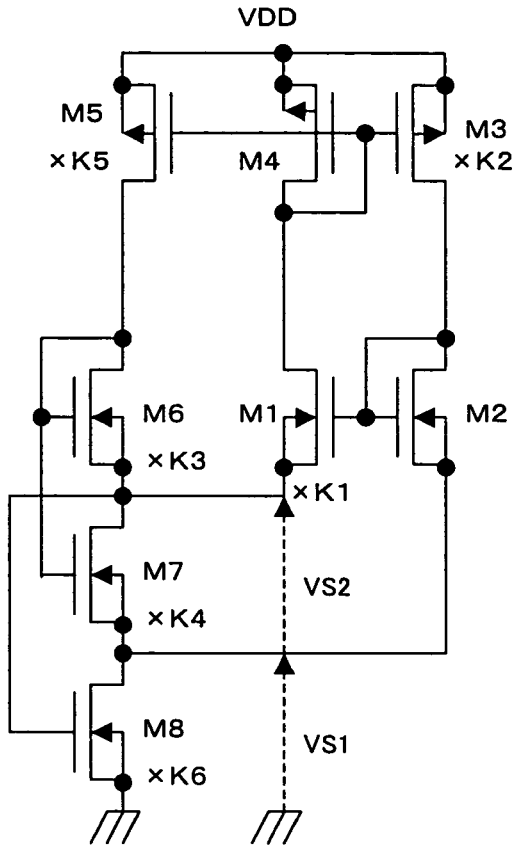
FIG. 18 is a diagram showing an example of a reference current circuit according to other embodiment of the present invention.

Next, FIG. 18 is a diagram showing a configuration of a CMOS reference current circuit according to an embodiment of the present invention. The MOS transistor M8 with the transconductance parameter ratio of $K_6$ with respect to the unit transistor M2 used as the reference is added, thereby causing overall circuit current to flow through this one MOS transistor. The MOS transistor M8 is assumed to operate in the saturation region. Likewise the following equation holds:

$$V_{S1}=V_r \ln(K_1K_2) \tag{63}$$

The respective drain currents $I_{D6}$, $I_{D7}$ and $I_{D8}$ of MOS transistors M6, M7 and M8 are given as follows:

$$I_{D6}=K_5I_1=K_3\beta(V_{GS7}-V_{S1}-V_{TH})^2 \tag{64}$$

$$I_{D7}=(K_5+1)I_{D1}=2nK_4\beta\{(V_{GS7}-V_{TH})V_{S1}-nV_{S1}^2/2\} \tag{65}$$

$$I_{D8}=(K_5+1/K_2+1)I_{D1}=K_6\beta(V_{S1}+V_{S2}-V_{TH})^2 \tag{66}$$

When Expression (66) is substituted into Expression (65), for solution of this, the following equation is likewise obtained:

$$I_{D1}=\frac{2n^2K_4^2K_5\beta V_{S1}^2}{K_3(K_5+1)^2}\left(1+\frac{K_3(K_5+1)(2-n)}{2nK_4K_5}\pm\sqrt{1-\frac{K_3(K_5+1)(2-n)}{nK_4K_5}}\right) \tag{67}$$

When Equation (63) is substituted into Equation (67), the following equation is likewise obtained:

$$I_{D1}=\frac{2n^2K_4^2K_5\beta V_r^2\{\ln(K_1K_2)\}^2}{K_3(K_5+1)^2}\left(1+\frac{K_3(K_5+1)(2-n)}{2nK_4K_5}\pm\sqrt{1-\frac{K_3(K_5+1)(2-n)}{nK_4K_5}}\right) \tag{68}$$

On the other hand, the transconductance parameter ratio $K_6$ should be set so that Expression (66) holds, or the MOS transistor M8 operates in the saturation region.

The temperature characteristic of the transconductance parameter β is expressed as follows due to:

$$\mu=\mu_0\left(\frac{T_0}{T}\right)^m \qquad \beta=\beta_0\left(\frac{T_0}{T}\right)^m \tag{69}$$

where m assumes the value between 1.5 and two (1.5<m<2).

Accordingly, the following equation is obtained:

$$I_{D1}=\frac{2n^2K_4^2K_5}{K_3(K_5+1)^2}\beta_0\left(\frac{T}{T_0}\right)^{2-m}\frac{k^2}{q^2}\{\ln(K_1K_2)\}^2\left(1+\frac{K_3(K_5+1)(2-n)}{2nK_4K_5}\pm\sqrt{1-\frac{K_3(K_5+1)(2-n)}{nK_4K_5}}\right) \tag{70}$$

In the above-mentioned Equations (67), (68), and (70), the symbol ± is used so that the solutions of the equations can be traced. Referring to FIG. 18, it can be seen that as the $K_4$ increases, the current $I_{D1}$ will increase. Thus, it is appropriate to replace the symbol ± by the + symbol.

Accordingly, the current $I_{D1}$ has a positive temperature characteristic. That is, the CMOS reference current circuit having the PTAT (proportional to absolute temperature) characteristic can be obtained. The reference current should be output from a current mirror circuit that is configured using the MOS transistor M4. As described above, the reference current circuit is constituted from the MOS transistors alone, without using resistance elements. Thus, the element variation occurs in the MOS transistors alone. The need for considering the element variation of the resistance elements is eliminated, so that the deviation of the variation can be correspondingly reduced.

Figure 19:
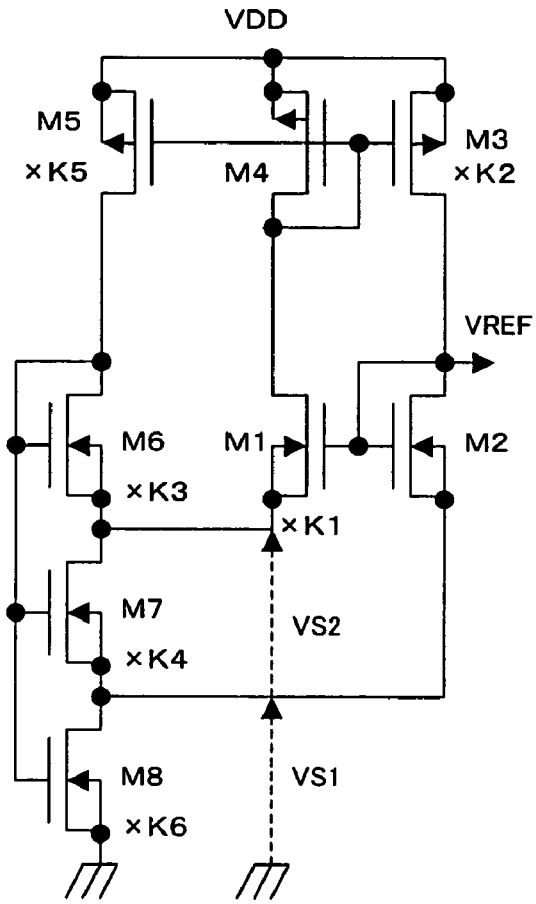
FIG. 19 is a diagram showing an example of a reference voltage circuit according to other embodiment of the present invention.

Further, FIG. 19 is a diagram showing a configuration of a CMOS reference current circuit/reference voltage circuit according to an embodiment of the present invention. The MOS transistor M8 with the transconductance parameter ratio of $K_6$ with respect to the unit transistor M2 used as the reference is added, thereby causing overall circuit current to flow through this one MOS transistor. The MOS transistor M8 is assumed to operate in the linear region. As in the embodiment described before, the following equation holds:

$$V_{S1}=V_r\ln(K_1K_2) \tag{71}$$

The respective drain currents $I_{D6}$, $I_{D7}$ and $I_{D8}$ of MOS transistors M6, M7 and M8 are given as follows:

$$I_{D6}=K_5I_{D1}=K_3\beta(V_{GS8}-V_{S1}-V_{S2}-V_{TH})^2 \tag{72}$$

$$I_{D7}=(K_5+1)I_{D1}=2nK_4\beta\{(V_{GS8}-V_{S2}-V_{TH})V_{S1}-nV_{S1}^2/2\} \tag{73}$$

$$I_{D8}=(K_5+1/K_2+1)I_{D1}=2nK_6\beta\{(V_{GS8}-V_{TH})V_{S2}-nV_{S2}^2/2\} \tag{74}$$

When Expression (72) is substituted into Expression (73) for solution of this, the following equation is likewise obtained:

$$I_{D1}=\frac{2n^2K_4^2K_5\beta V_{S1}^2}{K_3(K_5+1)^2}\left(1+\frac{K_3(K_5+1)(2-n)}{2nK_4K_5}\pm\sqrt{1-\frac{K_3(K_5+1)(2-n)}{nK_4K_5}}\right) \tag{75}$$

When Equation (75) is substituted into Equation (71), the following equation is likewise obtained:

$$I_{D1}=\frac{2n^2K_4^2K_5\beta V_r^2\{\ln(K_1K_2)\}^2}{K_3(K_5+1)^2}\left(1+\frac{K_3(K_5+1)(2-n)}{2nK_4K_5}\pm\sqrt{1-\frac{K_3(K_5+1)(2-n)}{nK_4K_5}}\right) \tag{76}$$

On the other hand, when the transconductance parameter ratio $K_6$ is set so that Expression (74) holds, the temperature characteristic of the transconductance parameter β is expressed as follows due to:

$$\mu=\mu_0\left(\frac{T_0}{T}\right)^m \qquad \beta=\beta_0\left(\frac{T_0}{T}\right)^m \tag{77}$$

where m assumes the value between 1.5 and two (1.5<m<2).

Accordingly, the following equation is obtained:

$$I_{D1} = \frac{2_n^2 K_4^2 K_5}{K_3(K_5+1)^2}\beta_0\left(\frac{T}{T_0}\right)^{2-m}\frac{k^2}{q^2}\{\ln(K_1K_2)\}^2\left(1 + \frac{K_3(K_5+1)(2-n)}{2nK_4K_5} \pm \sqrt{1 - \frac{K_3(K_5+1)(2-n)}{nK_4K_5}}\right) \quad (78)$$

In the above-mentioned Equations (75), (76), and (78), the symbol ± is used so that the solutions of the equations can be traced. Referring to FIG. 19, it can be seen that as the $K_4$ increases, the current $I_{D1}$ will increase. Thus, it is appropriate to replace the symbol ± by the + symbol. Accordingly, the current $I_{D1}$ has a positive temperature characteristic. That is, the CMOS reference current circuit having the PTAT (proportional to absolute temperature) characteristic can be obtained. The reference current should be output by configuring the MOS transistor M4 and the current mirror circuit 4.

As described above, the reference current circuit is constituted from the MOS transistors alone, without using resistance elements. Thus, the element variation occurs in the MOS transistors alone. The need for considering the element variation of the resistance elements is eliminated, so that the deviation of the variation can be correspondingly reduced.

Next, the $V_{S2}$ is derived. When Equations (71) and (76) are substituted into Expression (72), the following equation is obtained:

$$V_{GS2} - V_{TH} = \frac{\sqrt{2}\,nK_4K_5V_r\ln(K_1K_2)}{K_3(K_5+1)}\sqrt{1 + \frac{K_3(K_5+1)(2-n)}{2nK_4K_5} \pm \sqrt{\frac{K_3(K_5+1)(2-n)}{nK_4K_5}}} + V_r\ln(K_1K_2) + V_{S2} \quad (79)$$

When Equation (79) is substituted into Expression (74) to work out the $V_{S2}$, the following $V_{S2}$ is obtained:

$$V_{S2} = \frac{1}{K_0}\left(\frac{\sqrt{2}\,nK_4K_5V_r\ln(K_1K_2)}{K_3(K_5+1)}\sqrt{1 + \frac{K_3(K_5+1)(2-n)}{2nK_4K_5} \pm \sqrt{1 - \frac{K_3(K_5+1)(2-n)}{nK_4K_5}}}\right)\left\{1 \pm \sqrt{1 - \frac{K_3\left(K_5 + \frac{1}{K_2} + 1\right)}{K_3K_4}}\right\} \quad (80)$$

Thus, the $V_{S2}$ has a positive temperature characteristic. That is, it can be seen that both of $V_{S1}$, and the $V_{S2}$ have the positive temperature characteristic.

Further, the reference voltage $V_{REF}$ is derived. When Equation (5) is substituted into Equation (4) to make the following approximation:

$$I_{D1} = 2n\beta V_r^2\exp\left(\frac{V_{GS1} - V_{TH}}{nV_r}\right) = 2n\beta V_r^2\exp\left(\frac{V_{REF} - V_{S1} - V_{S2} - V_{TH}}{nV_r}\right) \quad (81)$$

The $V_{REF}$ is expressed as follows:

$$V_{REF} = nV_r\ln\left(\frac{I_{D1}}{2n\beta V_r^2}\right) + V_{S1} + V_{S2} + V_{TH} = V_r\left[n\ln\left\{\frac{nK_4^2K_5\{\ln(K_1K_2)\}^2}{K_3(K_5+1)^2}\left(1 + \frac{K_3(K_5+1)(2-n)}{2nK_4K_5} \pm \sqrt{1 - \frac{K_3(K_5+1)(2-n)}{nK_4K_5}}\right)\right\} + \ln(K_1K_2) + \frac{1}{K_5}\left(\frac{\sqrt{2}\,nK_4K_5\ln(K_1K_2)}{K_3(K_5+1)}\sqrt{1 + \frac{K_3(K_5+1)(2-n)}{2nK_4K_5} \pm \sqrt{1 - \frac{K_3(K_5+1)(2-n)}{nK_4K_5}}}\right)\left\{1 \pm \sqrt{1 - \frac{K_3\left(K_5 + \frac{1}{K_2} + 1\right)}{K_5K_6}}\right\}\right] + V_{TH} \quad (82)$$

More specifically, the reference voltage $V_{REF}$ is expressed by the sum of a voltage obtained by multiplying $V_T$ by a proportionality constant (larger than zero) and the threshold voltage $V_{TH}$. That is, when γ is regarded as the value within a bracket [ ] in Equation (82), the $V_{REF}$ can be expressed as follows:

$$V_{REF}=\gamma V_T+V_{TH} \tag{83}$$

The thermal voltage $V_T$ is approximately 26 mV at ambient temperature, and has the temperature characteristic of 3,333 ppm/° C. The temperature characteristic of the threshold voltage $V_{TH}$ is expressed as follows:

$$V_{TH}=V_{TH0}-\alpha(T-T_0) \tag{84}$$

In the CMOS process with the low threshold voltage, α is approximately 2.3 mV/° C. When the threshold voltage $V_{TH}$ at ambient temperature is set to 0.6V, the temperature characteristic of the reference voltage $V_{REF}$ can be canceled out by setting the γ to the value of 26.5385.

This value of the γ is the value that can be easily implemented by setting a transconductance parameter ratio $K_j$ of the MOS transistors M1 to M8 shown in FIG. 19 with respect to the unit transistors M2 and M4. The value of the reference voltage $V_{REF}$ in this case becomes 1.29V.

As described above, the circuit in FIG. 19 that constitutes one embodiment of the present invention can simultaneously implement the reference current circuit having the positive temperature characteristic (PTAT) and the reference voltage circuit that can output the reference voltage with the temperature characteristic canceled out. Further, the reference current/voltage circuit is constituted from the MOS transistors alone, without using resistance elements. Thus, the element variation occurs in the MOS transistors alone. The need for considering the element variation of the resistance elements is eliminated, so that the deviation of the variation can be correspondingly reduced.

The operation and effect of the embodiments of the present invention will be described.

A first effect is that the temperature characteristic can be reduced. The reason for this is that, according to the embodiments, the circuit is implemented only by the MOS transistors having the same temperature characteristics and the respective temperature characteristics are mutually cancelled out.

A second effect is that the MOS transistor can be operated in the linear region with reliability and that the nonlinear current mirror circuit can be configured using the MOS transistor in place of a resistance element. The reason for this is that, according to the embodiments, two MOS transistors with gate voltages made common are cascode-connected, for operation in the linear region.

A third effect is that a variation can be reduced. The reason for this is that, according to the embodiments, the MOS transistor is used in place of the resistance element, and no resistance element is employed.

The foregoing description was made in connection with the embodiments described above. The present invention, however, is not limited to the configurations of the embodiments described above. The present invention naturally includes various variations and modifications that could be made by those skilled in the art within the scope of the present invention.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A CMOS current mirror circuit comprising:

a first MOS transistor and a second MOS transistor constituting a current mirror; and a third MOS transistor with a gate terminal thereof biased to a predetermined potential, inserted between a source of said first or second MOS transistor in an input side or an output side of said current mirror and the ground to accommodate a predetermined nonlinear input-output characteristic, wherein:

gates of said first and second MOS transistors are connected in common;

a source of said first MOS transistor is grounded through said third MOS transistor;

a source of said second MOS transistor is directly grounded;

a source of said third MOS transistor is directly grounded, a drain of said third MOS transistor is connected to said source of said first MOS transistor and the gate of said third MOS transistor is connected to a bias voltage source;

the gate and a drain of said first MOS transistor is connected in common for current input; and an output current is supplied from a drain of said second MOS transistor.

2. A CMOS current mirror circuit comprising:

a first MOS transistor and a second MOS transistor constituting a current mirror; and a third MOS transistor with a gate terminal thereof biased to a predetermined potential, inserted between a source of said first or second MOS transistor in an input side or an output side of said current mirror and the ground to accommodate a predetermined nonlinear input-output characteristic, wherein:

gates of said first and second MOS transistors are connected in common;

a source of said first MOS transistor is directly grounded;

a source of said second MOS transistor is grounded through a third MOS transistor;

a source of said third MOS transistor is directly grounded, a drain of said third MOS transistor is connected to said source of said second MOS transistor, and a gate of said third MOS transistor is connected to a bias voltage source;

a gate of said first MOS transistor and a drain of said first MOS transistor are connected in common for current input; and an output current is supplied from a drain of said second MOS transistor.

3. A CMOS current mirror circuit comprising:

a first MOS transistor and a second MOS transistor constituting a current mirror; and a third MOS transistor with a gate terminal thereof biased to a predetermined potential, inserted between a source of said first or second MOS transistor in an input side or an output side of said current mirror and the ground to accommodate a predetermined nonlinear input-output characteristic, wherein:

a drain of said first MOS transistor and a gate of said second MOS transistor are connected in common;

a source of said first MOS transistor is directly grounded, and a gate of said first MOS transistor and said drain of said first MOS transistor are connected through said third MOS transistor;

a source of said third MOS transistor is connected to said drain of said first MOS transistor, a drain of said third MOS transistor is connected to said gate of said first MOS transistor, and a gate of said third MOS transistor is connected to a bias voltage source;

a source of said second MOS transistor is directly grounded;

an input current is applied to said drain of said third MOS transistor; and an output current is supplied from a drain of said second MOS transistor.

4. A CMOS current mirror circuit comprising:

a first MOS transistor and a second MOS transistor constituting a current mirror; and a third MOS transistor with a gate terminal thereof biased to a predetermined potential, inserted between a source of said first or second MOS transistor in an input side or an output side of said current mirror and the around to accommodate a predetermined nonlinear input-output characteristic, wherein:

gates of first and second transistors are connected in common;

a source of said first MOS transistor is connected to a power supply through said third transistor;

a source of said second MOS transistor is directly connected to said power supply;

a source of said third MOS transistor is directly connected to said power supply, a drain of said third MOS transistor is connected to said source of said first MOS transistor, and a gate of said third MOS transistor is connected to a bias voltage source;

a gate of said first MOS transistor and a drain of said first MOS transistor are connected in common for current input; and an output current is supplied from a drain of said second MOS transistor.

5. A CMOS current mirror circuit comprising:

a first MOS transistor and a second MOS transistor constituting a current mirror; and a third MOS transistor with a gate terminal thereof biased to a predetermined potential, inserted between a source of said first or second MOS transistor in an input side or an output side of said current mirror and the ground to accommodate a predetermined nonlinear input-output characteristic, wherein:

gates of first and second transistors are connected in common;

a source of said first MOS transistor is directly connected to a power supply;

a source of said second MOS transistor is connected to said power supply through said third MOS transistor;

a source of said third MOS transistor is directly connected to said power supply, a drain of said third MOS transistor is connected to said source of said second MOS transistor, and the gate of said third MOS transistor is connected to a bias voltage source;

a gate of said first MOS transistor and a drain of said first MOS transistor are connected in common for current input; and an output current is supplied from a drain of said second MOS transistor.

6. A CMOS current mirror circuit comprising:

a first MOS transistor and a second MOS transistor constituting a current mirror; and a third MOS transistor with a gate terminal thereof biased to a predetermined potential, inserted between a source of said first or second MOS transistor in an input side or an output side of said current mirror and the ground to accommodate a predetermined nonlinear input-output characteristic, wherein:

a drain of said first MOS transistor and a gate of said second MOS transistor are connected in common;

a source of said first MOS transistor is directly connected to a power supply, and a gate of said first MOS transistor and said drain of said first MOS transistor are connected through said third MOS transistor;

a source of said third MOS transistor is connected to said drain of said first MOS transistor, a drain of said third MOS transistor is connected to said gate of said first MOS transistor, and the gate of said third MOS transistor is connected to a bias voltage source;

a source of said second MOS transistor is directly connected to said power supply;

an input current is applied to said drain of said third MOS transistor; and an output current is supplied from a drain of said second MOS transistor.

7. The CMOS current mirror circuit according to claim 1, further comprising a fourth MOS transistor cascode-connected to said third MOS transistor, a gate of said fourth MOS transistor and a drain of said fourth MOS transistor being connected in common for current input; a bias voltage being supplied to said gate of said third MOS transistor.

8. The CMOS current mirror circuit according to claim 2, further comprising a fourth MOS transistor cascode-connected to said third MOS transistor, a gate of said fourth MOS transistor and a drain of said fourth MOS transistor being connected in common for current input; a bias voltage being supplied to said gate of said third MOS transistor.

9. The CMOS current mirror circuit according to claim 3, further comprising a fourth MOS transistor cascode-connected to said third MOS transistor, a gate of said fourth MOS transistor and a drain of said fourth MOS transistor being connected in common for current input; a bias voltage being supplied to said gate of said third MOS transistor.

10. The CMOS current mirror circuit according to claim 1, wherein a (W/L) ratio of a gate width to a gate length of said first MOS transistor is larger than a (W/L) ratio of a gate width to a gate length of said second MOS transistor.

11. The CMOS current mirror circuit according to claim 2, wherein a (W/L) ratio of a gate width to a gate length of said first MOS transistor is larger than a (W/L) ratio of a gate width to a gate length of said second MOS transistor.

12. A CMOS reference current circuit comprising:

the CMOS current mirror circuit as set forth in claim 1, at least said first MOS transistor and said second MOS transistor in the CMOS current mirror circuit being self-biased, for current output.

13. A CMOS reference current circuit comprising:

the CMOS current mirror circuit as set forth in claim 2, at least said first MOS transistor and said second MOS transistor being self-biased, for current output.

14. A CMOS reference current circuit comprising:

the CMOS current mirror circuit as set forth in claim 3, at least said first MOS transistor and said second MOS transistor being self-biased, for current output.

15. A CMOS reference voltage circuit comprising:

the CMOS reference current circuit as set forth in claim 12; and a circuit, receiving an output current from the CMOS reference current circuit, for converting the output current to voltage to output the so converted voltage as a reference voltage.

16. A CMOS reference voltage circuit comprising:

the CMOS reference current circuit as set forth in claim 13; and a circuit, receiving an output current from the CMOS reference current circuit, for converting the output current to voltage to output the so converted voltage as a reference voltage.

17. A CMOS reference voltage circuit comprising:

the CMOS reference current circuit as set forth in claim 14; and a circuit, receiving an output current from the CMOS reference current circuit, for converting the output current to voltage to output the so converted voltage as a reference voltage.

18. A CMOS reference voltage circuit comprising:

the CMOS reference current circuit as set forth in claim 12;

a fifth MOS transistor being grounded; and a sixth MOS transistor having a gate and a drain thereof connected in common for receiving an output current from the CMOS reference current circuit, said sixth MOS transistor being cascade-connected to said fifth MOS transistor;

a bias voltage being supplied to a gate of said fifth MOS transistor; a voltage obtained by voltage conversion through said fifth MOS transistor being output as a reference voltage.

* * * * *